US009542896B2

(12) United States Patent
Jung et al.

(10) Patent No.: US 9,542,896 B2
(45) Date of Patent: Jan. 10, 2017

(54) DISPLAY APPARATUS AND CONTROL METHOD THEREOF

(71) Applicant: SAMSUNG ELECTRONICS CO., LTD., Suwon-si (KR)

(72) Inventors: Jong-hoon Jung, Suwon-si (KR); Seong-woo Cho, Suwon-si (KR); Dae-sik Kim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 3 days.

(21) Appl. No.: 14/589,286

(22) Filed: Jan. 5, 2015

(65) Prior Publication Data

US 2015/0194088 A1 Jul. 9, 2015

(30) Foreign Application Priority Data

Jan. 3, 2014 (KR) ..... 10-2014-0000564

(51) Int. Cl.

| | |
|---|---|
| ***G09G 3/20*** | (2006.01) |
| ***G09G 3/32*** | (2016.01) |
| ***G09G 3/36*** | (2006.01) |
| ***G09G 3/34*** | (2006.01) |

(52) U.S. Cl.

CPC ..... *G09G 3/3607* (2013.01); *G09G 3/3413* (2013.01); *G09G 2310/0235* (2013.01); *G09G 2320/0242* (2013.01); *G09G 2320/064* (2013.01); *G09G 2340/0407* (2013.01); *G09G 2340/06* (2013.01)

(58) Field of Classification Search

None

See application file for complete search history.

(56) References Cited

U.S. PATENT DOCUMENTS

| | | | | |
|---|---|---|---|---|
| 7,248,268 | B2 | 7/2007 | Brown Elliott et al. | |
| 7,259,812 | B2 | 8/2007 | Park et al. | |
| 8,345,182 | B2 | 1/2013 | Sugita et al. | |
| 2008/0158207 | A1* | 7/2008 | Weng | G09G 3/3413 345/204 |
| 2011/0181634 | A1 | 7/2011 | Higashi et al. | |

(Continued)

FOREIGN PATENT DOCUMENTS

| | | | |
|---|---|---|---|
| JP | 4500321 | B2 | 7/2010 |
| KR | 10-0978254 | B1 | 8/2010 |

(Continued)

*Primary Examiner* — Joseph Haley
*Assistant Examiner* — Emily Frank
(74) *Attorney, Agent, or Firm* — Sughrue Mion, PLLC

(57) ABSTRACT

A control method of a display apparatus including a panel configured to include red (R), green (G), and white (W) subpixels, and a backlight configured to provide the panel with backlight using at least one of a white light source and a blue light source, including: converting image data into R, G, and blue (B) subframe data; turning on the R, G, and W subpixels according to the R, G, and B subframe data; and turning on the W subpixel, setting a brightness of the white light source to a brightness value of the R, G, and B subframe data, providing the panel with white light at the set brightness, turning on subpixels corresponding to remaining subframe data, setting at least one of the brightness of the white light source and a brightness of the blue light source, and providing the panel with light at the set brightnesses, is provided.

20 Claims, 19 Drawing Sheets

(56) References Cited

U.S. PATENT DOCUMENTS

| | | | | |
|---|---|---|---|---|
| 2012/0287168 | A1* | 11/2012 | Botzas | G09G 3/3413 345/690 |
| 2013/0135845 | A1 | 5/2013 | Matsui et al. | |
| 2015/0168774 | A1* | 6/2015 | Hosoki | G09G 3/3413 348/725 |

FOREIGN PATENT DOCUMENTS

| | | | |
|---|---|---|---|
| KR | 10-1011-0088400 | A | 8/2011 |
| KR | 10-2013-0058616 | A | 6/2013 |

* cited by examiner

| RESOLUTION | APERTURE RATIO | Color |
|---|---|---|
| 1 | 1 | 1 |
| 1.5 | 1.5 | R, G:0.75 |
| 1 | 1 | 1 |
| 1 | 1.5 | G:0.5 |
| 1 | 2 | R, G:0.5 |
| 1 | 1.5 | R:0.5 |
| 1 | 1.5 | R, G:0.75 |

DISPLAY APPARATUS AND CONTROL METHOD THEREOF

CROSS-REFERENCE TO RELATED APPLICATIONS

This application claims priority from Korean Patent Application No. 10-2014-0000564, filed on Jan. 3, 2014 in the Korean Intellectual Property Office, the disclosure of which is incorporated herein by reference in its entirety.

BACKGROUND

1. Field

Apparatuses and methods consistent with exemplary embodiments relate to a display apparatus and a control method thereof, and more particularly, to a display apparatus that displays an image using at least one of a white light source and a blue light source, and a control method thereof.

2. Description of the Related Art

Due to development of electronic technology, diverse types of display apparatuses have developed and propagated. In particular, large flat panel display apparatuses such as liquid crystal display (LCD) apparatuses and plasma display panel (PDP) display apparatuses have propagated recently and are being used in many households.

Since LCD displays cannot emit light autonomously, a backlight unit is generally used. The backlight unit includes diverse light sources such as white light emitting diodes (LEDs) and provides an LCD panel with backlight. The LCD panel displays a color image by filtering the backlight using red (R), green (G), and blue (B) color filters.

The R, G, and B color filters exist independently. Thus, since an area to pass light produced by the backlight unit is fixed, the ability to express colors is limited.

A white LED that uses a general yttrium aluminium garnet (YAG) fluorescent substance may express only a 75% color area in comparison with a National Television System Committee (NTSC) system. In a subpixel structure composed by independent R, G, and B subpixels, the white light is not passed though the subpixel structure without being filtered, but is instead expressed by a combination of the three primary colors, R, G, and B. Due to this feature, the brightness is lowered.

In order to solve this problem, a field sequential color (FSC) method in which colors are implemented by sequentially turning on R, G, and B light sources instead of using the color filters has developed. However, the FSC method has a problem of causing a color break-up (CBU) phenomenon. In addition, changes in brightness and wavelength of the R, G, and B light sources vary according to temperature. Accordingly, as the R, G, and B light sources are used over a period of time, color rendering may be degraded.

SUMMARY

Exemplary embodiments overcome the above disadvantages and other disadvantages not described above. Also, the exemplary embodiments are not required to overcome the disadvantages described above, and an exemplary embodiment may not overcome any of the problems described above.

One or more exemplary embodiments provide a display apparatus capable of realizing full color and a high brightness and operating in transparent mode, and a control method thereof.

According to an aspect of an exemplary embodiment, there is provided a display apparatus including: a panel configured to include red (R), green (G), and white (W) subpixels; a backlight configured to provide the panel with backlight using at least one of a white light source and a blue light source; an image processor configured to convert image data into red (R), green (G), and blue (B) subframe data; a panel driver configured to turn on the R, G, and W subpixels according to the R, G, and B subframe data respectively; a backlight driver configured to drive the backlight; and a controller configured to control the panel driver to turn on the W subpixel, set a brightness of the white light source to a brightness value of the R, G, and B subframe data, control the backlight driver to drive the white source to provide the panel with white light at the set brightness, control the panel driver to turn on subpixels respectively corresponding to remaining subframe data other than the R, G, and B subframe data corresponding to the brightness value, set at least one of the brightness of the white light source and a brightness of the blue light source, and control the backlight driver to drive at least one of the white light source and the blue light source to provide light at the set brightnesses.

The controller may be further configured to control the panel driver to turn on at least one of the R and G subpixels respectively corresponding to at least one of remaining R and G subframe data among the remaining subframe data, and set the brightness of the white light source to correspond to at least one of the remaining R and G subframe data, and the controller may be further configured to control the panel driver to turn on the W subpixel corresponding to remaining B subframe data among the remaining subframe data, and set the brightness of the blue light source to correspond to the remaining B subframe data.

The brightness value may correspond to a smallest value among the R, G, and B subframe data.

The W subpixel may be transparent.

The display apparatus may be configured to provide a first transparent mode and a second transparent mode, and in the first transparent mode, the controller may be further configured to control the panel driver to turn off all the R, G, and W subpixels, and control the backlight driver to drive at least one of the white light source and the blue light source to provide the panel with light, and in the second transparent mode, the controller may be further configured to control the panel driver turn off all the R, G, and W subpixels, and control the backlight driver to turn off the white light source and the blue light source.

The blue light source may include a plurality of blue light emitting diodes (LEDs), and the white light source may include a plurality of white LEDs in which blue LEDs are coated with phosphor, and each blue LED and each white LED may be integrated on a single LED chip.

The blue light source may include a plurality of blue LED chips, and the white light source may include a plurality of white LED chips in which blue LEDs are coated with phosphor, and each blue LED chip and each white LED chip are arranged side by side.

The controller may be further configured to control the backlight driver to drive at least one of the white light source and the blue light source using a pulse width modulation (PWM) dimming method to provide light at the set brightnesses.

The image processor may be further configured convert the image data into a form corresponding to a PenTile™ structure, and convert the converted image data into the R, G, and B subframe data.

According to an aspect of another exemplary embodiment, there is provided control method of a display apparatus including a panel configured to include red (R), green (G), and white (W) subpixels, and a backlight configured to provide the panel with backlight using at least one of a white light source and a blue light source, the method including: converting image data into red (R), green (G), and blue (B) subframe data; turning on the R, G, and W subpixels according to the R, G, and B subframe data respectively; and turning on the W subpixel, setting a brightness of the white light source to a brightness value of the R, G, and B subframe data, providing the panel with white light at the set brightness, turning on subpixels respectively corresponding to remaining subframe data other than the R, G, and B subframe data corresponding to the brightness value, setting at least one of the brightness of the white light source and a brightness of the blue light source, and providing the panel with light at the set brightnesses.

The operation of providing the panel with the light at the set brightness may include: turning on at least one of the R and G subpixels respectively corresponding to at least one of remaining R and G subframe data among the remaining subframe data; setting the brightness of the white light source to correspond to at least the remaining R and G subframe data; turning on the W subpixel corresponding to remaining B subframe data among the remaining subframe data; and setting the brightness of the blue light source to correspond to the remaining B subframe data.

The brightness value may correspond to a smallest value among the R, G, and B subframe data.

The W subpixel may be transparent.

The display apparatus may provide a first transparent mode and a second transparent mode, and may further include: in the first transparent mode, turning off all the R, G, and W subpixels, and turning on at least one of the white light source and the blue light source, and in the second transparent mode, turning off all the R, G, and W subpixels, and turning off the white light source and the blue light source.

The blue light source may include a plurality of blue light emitting diodes (LEDs), and the white light source may include a plurality of white LEDs in which blue LEDs are coated with phosphor, and each blue LED and each white LED are integrated on a single LED chip.

The blue light source may include a plurality of blue LED chips, and the white light source may include a plurality of white LED chips in which blue LEDs are coated with phosphor, and each blue LED chip and each white LED chip are arranged side by side.

In the operation of providing the panel with the adjusted light, the brightness of at least one of the white light source and the blue light source may be adjusted using a pulse width modulation (PWM) dimming method.

In the operation of converting the image data into the R, G, and B subframe data, the image data may be converted into a form corresponding to a PenTile™ structure and then may be converted into the R, G, and B subframe data.

According to an aspect of another exemplary embodiment, there is provided display apparatus including: a panel including a red (R), a green (G), and a white (W) subpixel; a backlight including a white light source and a blue light source and configured to provide light to the panel; and a controller configured to turn on the W subpixel, drive the white light source based on a smallest value among R, G, and B subframe data, calculate remaining R, G, and B subframe data by subtracting the smallest value from each of the R, G, and B subframe data, turn on subpixels among the R, G, and W subpixels according the remaining R, G, and B subframe data respectively, and drive at least one of the white light source and the blue light source based on the remaining R, G, and B subframe data.

The controller may be further configured drive the display apparatus in one of a first transparent mode and a second transparent mode, wherein the controller may be further configured to, in the first transparent mode, turn off all of the R, G, and W subpixels, and drive at least one of the white light source and the blue light source, and wherein the controller may be further configured to, in the second transparent mode, turn off all of the R, G, and W subpixels, and turn off the white light source and the blue light source.

According to the diverse exemplary embodiments, the white light source and the blue light source are individually controlled so that the brightness may be improved, alteration of color caused by difference in characteristics of the light sources may be solved, and the display apparatus may operate in transparent mode.

Additional and/or other aspects and advantages of the exemplary embodiments will be set forth in part in the description which follows and, in part, will be obvious from the description, or may be learned by practice of the exemplary embodiments.

BRIEF DESCRIPTION OF THE DRAWINGS

The above and/or other aspects will become more apparent by describing certain exemplary embodiments with reference to the accompanying drawings, in which.

DETAILED DESCRIPTION OF EXEMPLARY EMBODIMENTS

Figure 1:
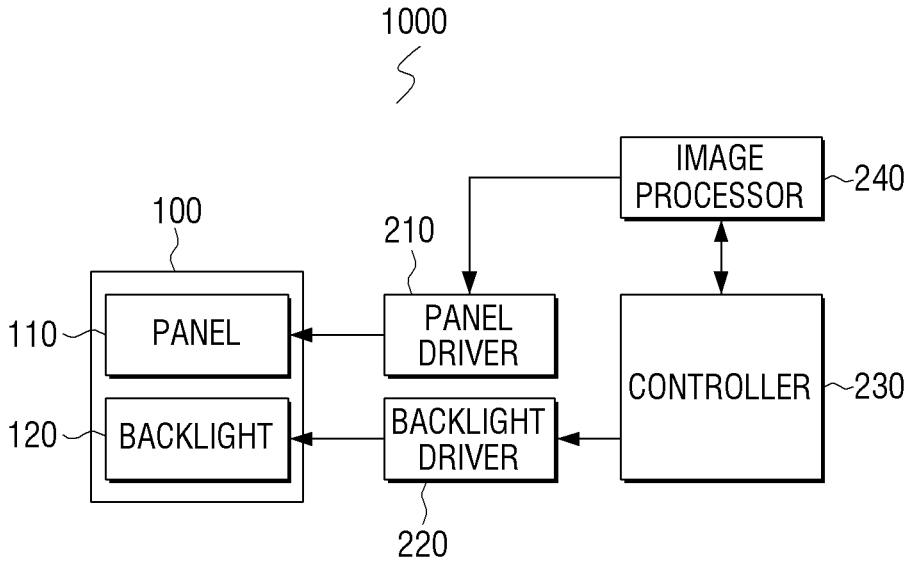
FIG. 1 is a block diagram of a configuration of a display apparatus according to an exemplary embodiment.

Certain exemplary embodiments will now be described in greater detail with reference to the accompanying drawings.

In the following description, same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a block diagram of a configuration of a display apparatus according to an exemplary embodiment.

With reference to FIG. 1, the display apparatus 1000 may include a display panel 100, a panel driver 210, a backlight driver 220, a controller 230, and an image processor 240.

The display panel 100 may include a panel 110 and a backlight 120. The panel 110 may include red (R), green (G), and white (W) subpixels. The panel 110 turns on corresponding R, G, and W subpixels according to red (R), green (G), and blue (B) subframe data of image data.

The backlight 120 may include a white light source and a blue light source. The backlight 120 may provide the panel 110 with backlight using at least one of the white light source and the blue light source.

The image processor 240 processes image data, and generates frame data of different colors. The image processor 240 may convert image data input from an external source into R, G, and B subframe data. More specifically, the image processor 240 may detect R, G, and B channel values from the image data, and generate R, G, and B subframe data corresponding to the detected R, G, and B channel values respectively.

The panel driver 210 may turn on a subpixel of a color corresponding to each color subframe data. More specifically, the panel driver 210 may turn on R, G, and W subpixels corresponding to the R, G, and B color subframe data respectively.

The backlight driver 220 provides a backlight driving signal to drive the backlight 120.

The controller 230 controls the overall operation of the display apparatus 1000. More specifically, the controller 230 may control the panel driver 210 to turn on a subpixel of a color corresponding to each color subframe data, and may control the backlight driver 220 to turn on at least one of the white light source and the blue light source according to a driving state of the panel 110.

For example, when image data is converted into R, G, and B subframe data, the controller 230 may control the panel driver 210 to turn on an R subpixel corresponding to the R subframe data, and may control the backlight driver 220 to turn on the white light source.

In addition, the controller 230 may control the panel driver 210 to turn on a G subpixel corresponding to the G subframe data, and may control the backlight driver 220 to turn on the white light source.

In addition, the controller 230 may control the panel driver 210 to turn on a W subpixel corresponding to the B subframe data, and may control the backlight driver 220 to turn on the blue light source.

In addition, the controller 230 may turn on a W subpixel, adjust the brightness of the white light source to a brightness value expressed by the R, G, and B subframe data, and provide the panel 110 with the adjusted white light (i.e., by controlling the backlight driver 220 to drive the white light source), turn on subpixels corresponding to the remaining subframe data respectively (i.e., R, G, and B subframe data other than the R, G, and B subframe data corresponding to the brightness value), adjust the brightness of at least one of the white light source and the blue light source, and provide the panel 110 with the adjusted light (i.e., by controlling the backlight driver 220 to drive at least one of the white light source and the blue light source).

In other words, when the same amounts of R, G, and B subframe data are combined, white light is produced. Accordingly, same amounts of R, G, and B subframe data may be expressed as data which expresses a same amount of white light.

Accordingly, the white light corresponding to the same amount may be expressed using a W subpixel and the white light source, and each of the remaining R, G, and B subframe data other than the data used to express the white light may be expressed using R, G, and W subpixels and at least one of the white light source and the blue light source.

More specifically, the controller 230 may turn on at least one of the R and G subpixels for the remaining data other than data corresponding to the brightness value from among at least one of the R and G subframe data, and adjust the brightness of the white light source based on the remaining data. The brightness value may be interpreted as white light expressed by combining the same amounts of R, G, and B subframe data.

Accordingly, the controller 230 may turn on an R subpixel for the remaining R subframe data other than data corresponding to the brightness value from among the R subframe data, and adjust the brightness of the white light source to correspond to the remaining R subframe data.

In addition, the controller 230 may turn on a G subpixel for the remaining G subframe data other than data corresponding to the brightness value from among the G subframe data, and adjust the brightness of the white light source to correspond to the remaining G subframe data.

The controller 230 may turn on a W subpixel for the remaining B subframe data other than data corresponding to the brightness value from among the B subframe data, and adjust the brightness of the blue light source to correspond to the remaining B subframe data.

In particular, in order to calculate the same amount of R, G, and B subframe data which is combined to express the white light, the controller 230 may detect a minimum value among the R, G, and B subframe data. In other words, the minimum value among the R, G, and B subframe data is the same as the amounts of R, G, and B subframe data which are combined to express the white light.

Accordingly, the white light expressed by combining R, G, and B subframe data is expressed by combining R, G, and B subframe data having the same amount as the minimum value among the R, G, and B subframe data.

Therefore, the controller 230 may turn on a W subpixel to correspond to the minimum value among the R, G, and B subframe data, and provide light from the white light source to the panel 110 so that the brightness value expressed by the R, G, and B subframe data may be expressed.

The process of detecting the minimum value among the R, G, and B subframe data, turning on the W subpixel to correspond to the minimum value, and providing light from the white light source to the panel 110, and the process of turning on one of the R, G, and W subpixels to correspond to the remaining R, G, and B subframe data, and using at least one of the white light source and the blue light source will be described in greater detail below.

The controller 230 may turn on one of the R, G, and W subpixels for the remaining data other than data corresponding to a brightness value from among each of the R, G, and B subframe data, and may adjust the brightness of at least one of the white light source and the blue light source using a pulse width modulation (PWM) dimming method. Accordingly, using the PWM dimming method, the controller 230 may adjust the brightness of at least one of the white light source and the blue light source adaptively to correspond to each of the remaining R, G, and B subframe data.

Each pixel of the panel 110 does not include R, G, and B subpixels as in the related-art display apparatuses, but includes at least one W subpixel, along with R and G subpixels. Accordingly, when the remaining color subpixels other than the white subpixel are turned on, and when the white light source is turned on, colors having R and G properties are expressed, and when the white subpixel is turned on, and when the blue light source is turned on, colors having B properties are expressed.

Consequently, a color image may be expressed by a combination of R, G, and W subpixels and at least one of the white light source and the blue light source. In addition, since the white subpixel is used, the related-art problem of deterioration of the brightness may be resolved and a 100% full color area may be reproduced in comparison with a NTSC system.

Figure 2:
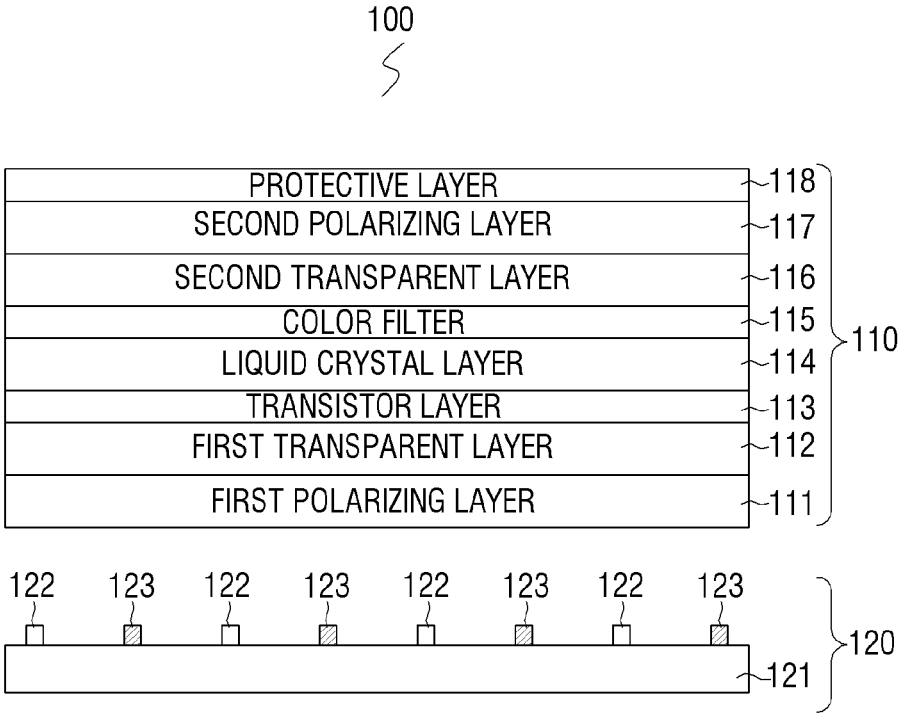
FIG. 2 illustrates a configuration of a panel and a backlight according to an exemplary embodiment.

FIG. 2 illustrates a configuration of the panel 110 and the backlight 120 according to an exemplary embodiment. With reference to FIG. 2, the panel 110 in the display panel 100 may include a first polarizing layer 111, a first transparent layer 112, a transistor layer 113, a liquid crystal layer 114, a color filter 115, a second transparent layer 116, a second polarizing layer 117, and a protective layer 118.

The first polarizing layer 111 filters light emitted from the backlight 120 and transmits only light of a first polarizing direction. The first polarizing layer 111 may be implemented with a horizontal polarizing filter or a vertical polarizing filter. The second polarizing layer 117 may be implemented with a polarizing filter which is tilted at a 90° angle with respect to the first polarizing layer 111. In other words, when the first polarizing layer 111 is a horizontal polarizing filter, the second polarizing layer 117 is a vertical polarizing filter. The first polarizing layer 111 is not always provided horizontally or vertically, but may be tilted at a 45° angle. In this case, the second polarizing layer 117 has only to be tilted at a 90° angle with respect to the first polarizing layer 111.

Since the first and second polarizing layers 111 and 117 are tilted at a 90° angle with respect to each other, light would not normally be transmitted through the first and second polarizing layers 111 and 117. However, while light passing through the first polarizing layer 111 penetrates the liquid crystal layer 114, a polarizing direction changes. Thereafter, the light passes through the second polarizing layer 117 and goes into a viewer's eyes. In other words, when an electrical signal is not transmitted to the liquid crystal in the liquid crystal layer 114, liquid crystal in the liquid crystal layer 114 is tilted at a 90° angle with respect to the first polarizing layer 111. Accordingly, while light filtered horizontally by the first polarizing layer 111 penetrates the liquid crystal layer 114, a polarizing direction of the light changes vertically and thus the light can pass through the second polarizing layer 117. When the white light source in the backlight 120 is turned on, white light passes as it is so that a white color is expressed. However, when an electrical signal is transmitted to liquid crystal in the liquid crystal layer 114, the liquid crystal is arranged so that light passes without the polarizing direction of the light being changed. Accordingly, the light is filtered by the second polarizing layer 117 and thus cannot be transmitted through the second polarizing layer 117, such that a corresponding pixel is expressed in black.

The first transparent layer 112 transmits light passing through the first polarizing layer 111 as it is. The first transparent layer 112 may be formed of glass or other transparent polymer substances.

The transistor layer 113 includes a plurality of transistors to turn on or turn off liquid crystal cells in the liquid crystal layer 114. Each transistor may be implemented with a thin film transistor (TFT). Each TFT is connected to a corresponding liquid crystal cell in the liquid crystal layer 114. Accordingly, in a screen composition of SVGA (800×600), TFTs of 3×480,000 are used. The TFT is an element that acts as a switch for each pixel. When the TFT is turned on, molecule arrangement of the liquid crystal changes due to voltage difference between both ends of the pixel. In other words, as described above, a polarizing direction of light either changes or does not change as it passes through the liquid crystal layer 114.

The liquid crystal layer 114 includes a plurality of liquid crystal cells. The liquid crystal is a substance having regular molecule arrangement like a solid. The liquid crystal molecules are twisted when the electricity does not flow, but when the electricity is on, the liquid crystal molecules are arranged in a line along a direction. Each liquid crystal cell includes a common electrode, and a subpixel electrode which faces the respective common electrode across the liquid crystal and which is electrically connected to each TFT in the transistor layer 113.

The color filter 115 adds color to light passing through the liquid crystal layer 114. The color filter 115 may be divided into diverse color filter areas according to exemplary embodiments. The size of each filter area may correspond to each liquid crystal cell in the liquid crystal layer 114. In this specification, a liquid crystal cell and a corresponding filter area are referred to as a subpixel for convenient description.

In an exemplary embodiment, the color filter 115 may be implemented with a repeated arrangement of red (R), green (G), and white (W) filter areas. In other words, the panel 110 has a form in which R, G, and W subpixels are combined and arranged repeatedly. In particular, there may be diverse forms in which R, G, and W subpixels are combined and arranged repeatedly. This will be described in greater detail below.

The panel driver 210 may turn on or turn off each subpixel by applying an electrical signal to a liquid cell corresponding to each subpixel or blocking an electrical signal. Consequently, diverse color components such as red, green, and blue can be expressed. The panel driver 210 may adjust the ratio of R, G, and B by appropriately adjusting a turn-on time of each subpixel. Accordingly, diverse natural colors can be expressed.

The second transparent layer 116 transmits light passing through the color filter 115 towards the second polarizing layer 117. The second transparent layer 116 may also be formed of diverse transparent substances such as glass as in the first transparent layer 112.

The second polarizing layer 117 transmits light of a corresponding polarizing direction as described above, and blocks light of other polarizing directions.

The protective layer 118 is a layer coated to protect the exterior of the panel 110. The protective layer 118 may also be formed of a transparent substance such as glass.

The liquid crystal layer 114 in the panel 110 needs backlight since the liquid crystal layer 114 cannot emit light by itself.

The backlight 120 uses a white light source 122 or a blue light source 123 to provide the panel 110 with backlight. The white light source 122 is a light source to output white light including the three primary colors, R, G, and B, and may be implemented with a general lamp, but is implemented with a white light emitting diode (LED) in this exemplary embodiment. Similarly, the blue light source 123 may be implemented with a blue LED.

The white LED may be an LED which is transformed from a blue LED which emits blue light by being coated with phosphor. The phosphor may be Eu or Ce which are rare earth materials.

Although the color filter 115 does not include a blue subpixel, the backlight 120 uses the blue light source 124 so that all the R, G, and B properties may be expressed. A detailed expression method will be described in greater detail below.

Figure 3:
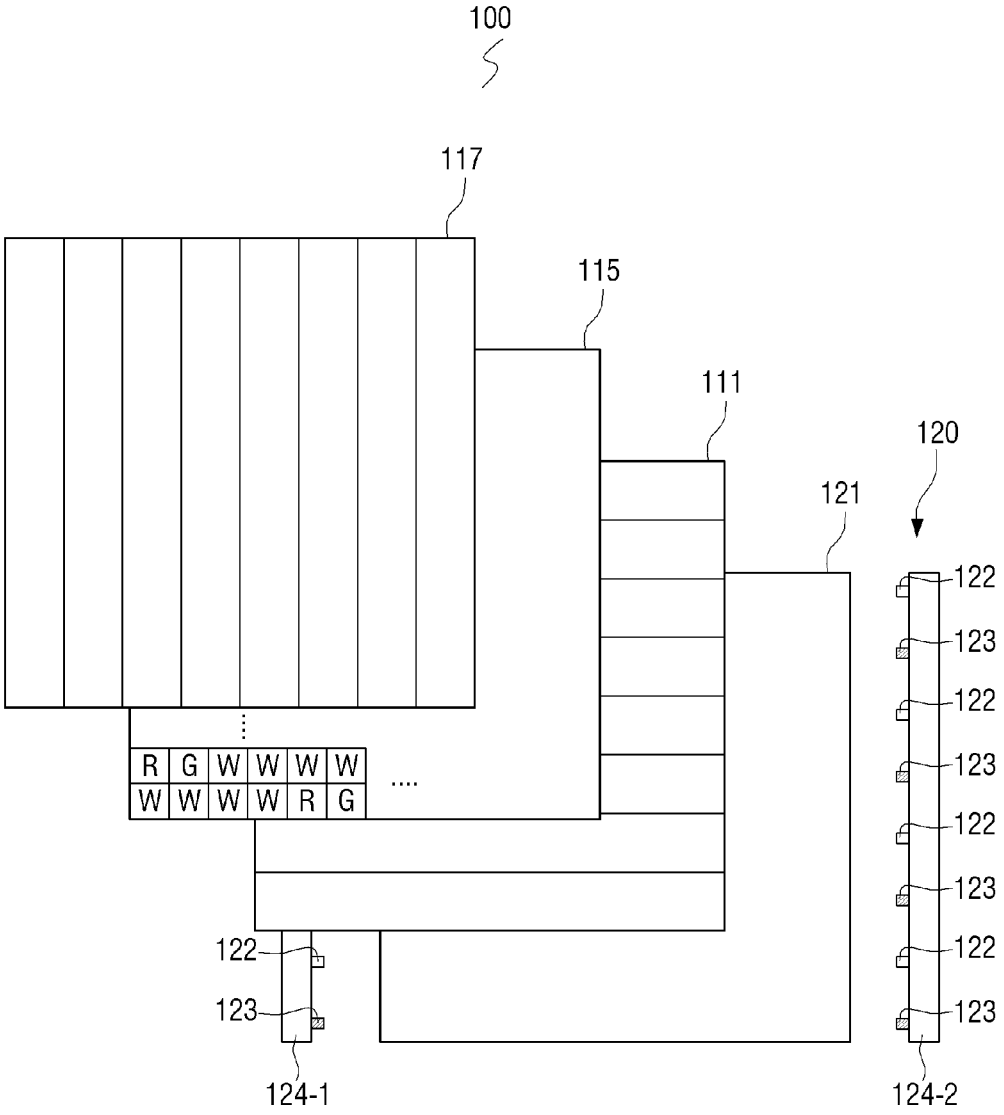
FIG. 3 briefly illustrates an internal configuration of a display panel in three dimensions according to an exemplary embodiment.

FIG. 3 briefly illustrates an internal configuration of the display panel 100 in three dimensions according to an exemplary embodiment. With reference to FIG. 3, the backlight 120 is provided on the lower side, and diverse panel layers are sequentially provided on the upper side to compose the panel 110.

In FIG. 3, an example of an edge-lit backlight 120 is illustrated. With reference to FIG. 3, the backlight 120 may include a light guide plate (LGP) 121, first and second LED bars 124-1 and 124-2, a plurality of white LEDs 122, and a plurality of blue LEDs 123.

The white LEDs 122 and blue LEDs 123 are alternately arranged on the first and second LED bars 124-1 and 124-2. The first and second LED bars 124-1 and 124-2 include diverse electrical wirings to apply an electrical signal to each LED 122 and 123, and are provided at two edges of the LGP 121 to emit light from the two edges. The light emitted from the two edges spreads through the LGP 121 in two dimensions, passes through a spreading sheet (not shown) and a prism sheet (not shown) on the LGP 121, and is concentrated in a front direction.

The first polarizing layer 111 transmits light of a first polarizing direction among the backlight emitted from the backlight 120 towards the liquid crystal layer 114 and the color filter 115 as described above.

With reference to FIG. 3, at the color filter 115, R, G, and W subpixels are sequentially provided. In particular, a plurality of W pixels may be provided. The R, G, and W subpixels compose a single pixel, and a portion of the plurality of W subpixels may be used to express blue color using the blue light source of the backlight, and the remaining W subpixel may be used to compensate the brightness using the white light source.

For example, at the color filter 115, an R subpixel, a G subpixel, and four W subpixels may be provided, and the R, G, W subpixels may compose a single pixel. The R subpixel is used to express red color, the G subpixel is used to express green color, one of the four W subpixels is used to express blue color using the blue light source of the backlight, and the other W subpixel is used to compensate the brightness using the white light source.

In addition, any number of the four W subpixels (e.g., all four W subpixels) may be used to express blue color using the blue light source and to compensate the brightness using the white light source. Whether to turn on or turn off the blue light source or the white light source may be performed by PWM control.

More specifically, in order to express color frame data in which R and G are mixed, the panel driver 210 turns on the R and G subpixels, and the backlight driver 220 turns on the white light source 122. Accordingly, red color and green color are expressed by the R and G subpixels. In this case, when the W subpixel is turned on together with the R and G subpixels, the brightness may be improved. However, since the white light is added, color to be expressed may be altered. Accordingly, whether to turn on the W subpixel may be determined differently according to the product in consideration of the brightness properties and the color properties.

Alternatively, the panel driver 210 may turn on the R and G subpixels separately, and the backlight driver 220 turns on the white light source so that red color and green color may be expressed separately.

Subsequently, in order to express B color frame data, the panel driver 210 turns off the R and G subpixels and turns on the W subpixel, and the backlight driver 220 turns on the blue light source 123. Since the blue light passes through the W subpixel area as it is, blue color is expressed. In this exemplary embodiment, the R and G subpixels are turned off, but since the R and G subpixels do not transmit the blue light, the R and G subpixels may maintain the turned-on state. This operation may be employed differently according to exemplary embodiments.

Consequently, red, green, and blue colors are sequentially combined so that a color image may be expressed.

Figure 4:
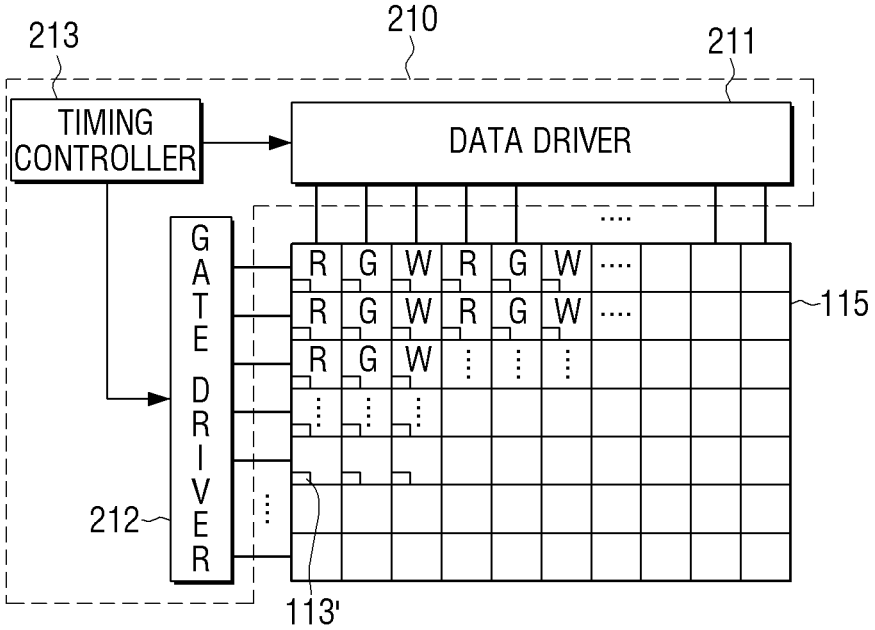
FIG. 4 illustrates an example of a configuration of a panel driver to drive each subpixel in the panel according to an exemplary embodiment.

FIG. 4 illustrates an example of a configuration of the panel driver 210 to drive each subpixel in the panel 100 according to an exemplary embodiment.

With reference to FIG. 4, the panel driver 210 may include a data driver 211, a gate driver 212, and a timing controller 213.

The data driver 211 is connected to the liquid crystal cells in the panel 110 through a plurality of data lines respectively.

The gate driver 212 is connected to the liquid crystal cells in the panel 110 through a plurality of gate lines respectively.

Each data line is connected to a source electrode of each TFT 113' in the transistor layer 113, and each gate line is connected to a gate electrode of each TFT 113'. In FIG. 4, each liquid crystal cell may be an R subpixel, a G subpixel, or a W subpixel.

The gate driver 212 performs scan operation to turn on a pixel corresponding to each color frame by applying a scan pulse through the gate line. The data driver 211 performs display operation by applying a data signal corresponding to each pixel value of image data to the scanned pixel.

The timing controller 213 applies a control signal to the data driver 211 and the gate driver 212 according to image data provided by the image processor 240, and controls the driver 211 and the gate driver 212 to perform the scan operation and the display operation accordingly.

In the exemplary embodiment of FIG. 4, the timing controller 213 is used, but a display apparatus having a small panel may replace the timing controller 213 with a central processing unit (CPU).

In FIG. 3, the edge-lit backlight 120 is used. However, the exemplary embodiments are not limited thereto, and e.g., a direct-lit backlight may also be used.

Figure 5:
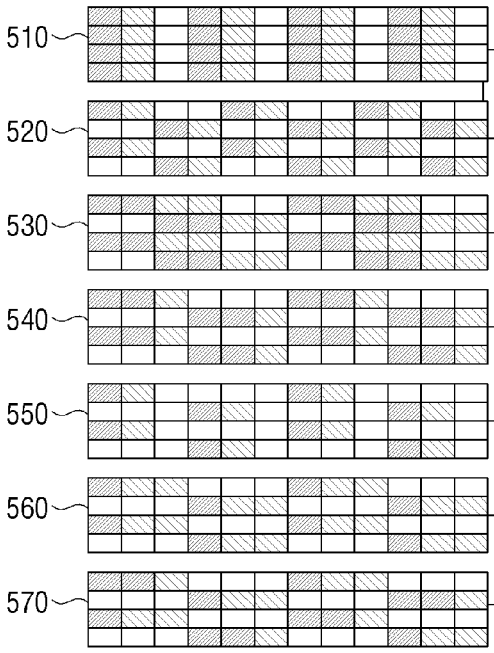
FIG. 5 illustrates combinations of R, G, and W subpixels and repeated arrangement forms according to exemplary embodiments.

FIG. 5 illustrates combinations of R, G, and W subpixels and repeated arrangement forms according to an exemplary embodiment.

With reference to FIG. 5, the panel 110 may include diverse combinations 510, 520, 530, 540, 550, 560, and 570 of repeatedly arranged R, G, and W subpixels.

The first combination 510 of R, G, and W subpixels composes a single pixel by combining one R subpixel, one G subpixel, and one W subpixel. The first combination 510 may express resolution of 1, aperture ratio of 1, and color of 1 due to the same ratio of the R, G, and W subpixels. As the number of pixels formed by grouping the subpixels in a different manner increases, the resolution increases. As the proportion of W subpixels increases, the aperture ratio increases. As the proportion of R and G subpixels increases, color sense is improved. Herein, color and color sense have the same meaning.

The second combination 520 of R, G, and W subpixels composes a single pixel by combining one R subpixel, one G subpixel, and two W subpixels. The second combination 520 may compose a single pixel by horizontally combining one R subpixel, one G subpixel, and two W subpixels, or by vertically combining one R subpixel, one G subpixel, and two W subpixels. Accordingly, since the number of pixels formed by grouping the subpixels in a different manner increases, the resolution is increased to 1.5. Since the proportion of W subpixels increases, the aperture ratio is increased to 1.5. On the contrary, since the proportion of R and G subpixels decreases, color sense is reduced to 0.75.

The third combination 530 of R, G, and W subpixels composes a single pixel by combining two R subpixels, two G subpixels, and two W subpixels. The third combination 530 has the same ratio of R, G, and W subpixels as the first combination 510 of R, G, and W subpixels, so that resolution of 1, aperture ratio of 1, and color of 1 may be expressed.

The fourth combination 540 of R, G, and W subpixels composes a single pixel by combining two R subpixels, one G subpixel, and three W subpixels. The fourth combination 540 may be acquired by replacing a single G subpixel of the third combination 530 with a W subpixel so that one more W subpixel is increased relatively. Accordingly, the resolution is 1 as above, the aperture ratio is increased to 1.5, and green color sense is reduced to 0.5 since the G subpixel disappears.

The fifth combination 550 of R, G, and W subpixels composes a single pixel by combining one R subpixel, one G subpixel, and four W subpixels. The fifth combination 550 may be acquired by replacing a single R subpixel of the fourth combination 540 with a W subpixel so that one more W subpixel is increased relatively. Accordingly, the resolution is 1 as above, the aperture ratio is increased to 2, and red color sense is also reduced to 0.5 since the R subpixel disappears.

The sixth combination 560 of R, G, and W subpixels composes a single pixel by combining one R subpixel, two G subpixels, and three W subpixels. The sixth combination 560 may be acquired by replacing a single W subpixel of the fifth combination 550 with a G subpixel so that one more G subpixel is increased relatively. Accordingly, the resolution is 1 as above, the aperture ratio is reduced to 1.5, and only red color sense is 0.5 since one more G subpixel is increased relatively.

The seventh combination 570 of R, G, and W subpixels composes a single pixel by combining two R subpixels, one G subpixel, and three W subpixels. The seventh combination 570 may be acquired by replacing a single G subpixel of the sixth combination 560 with an R subpixel so that one more R subpixel is increased relatively. Accordingly, the resolution is 1 as above, the aperture ratio is 1.5 as above, and red color sense and green color sense are slightly increased to 0.75.

The diverse combinations 510, 520, 530, 540, 550, 560, and 570 of repeatedly arranged R, G, and W subpixels are referred to as PenTile™ structures. The PenTile™ structure is a technology to innovatively increase the aperture ratio, in which a pixel consists of R, G, B, and W subpixels so that the W subpixel transmits white light. Accordingly, they are different kinds of PenTile™ structures. In this exemplary embodiment, the diverse combinations 510, 520, 530, 540, 550, 560, and 570 of repeatedly arranged R, G, and W subpixels also increase the aperture ratio by including the W subpixel.

The blue light source includes a plurality of blue LEDs, and the white light source includes a plurality of white LEDs in which blue LEDs are coated with phosphor. Each blue LED and each white LED may be integrated on one LED chip.

In addition, the blue light source includes a plurality of blue LEDs, and the white light source includes a plurality of white LEDs in which blue LEDs are coated with phosphor. Each blue LED and each white LED may be arranged side by side. A detailed description is provided with reference to FIGS. 6 and 7.

Figure 6:
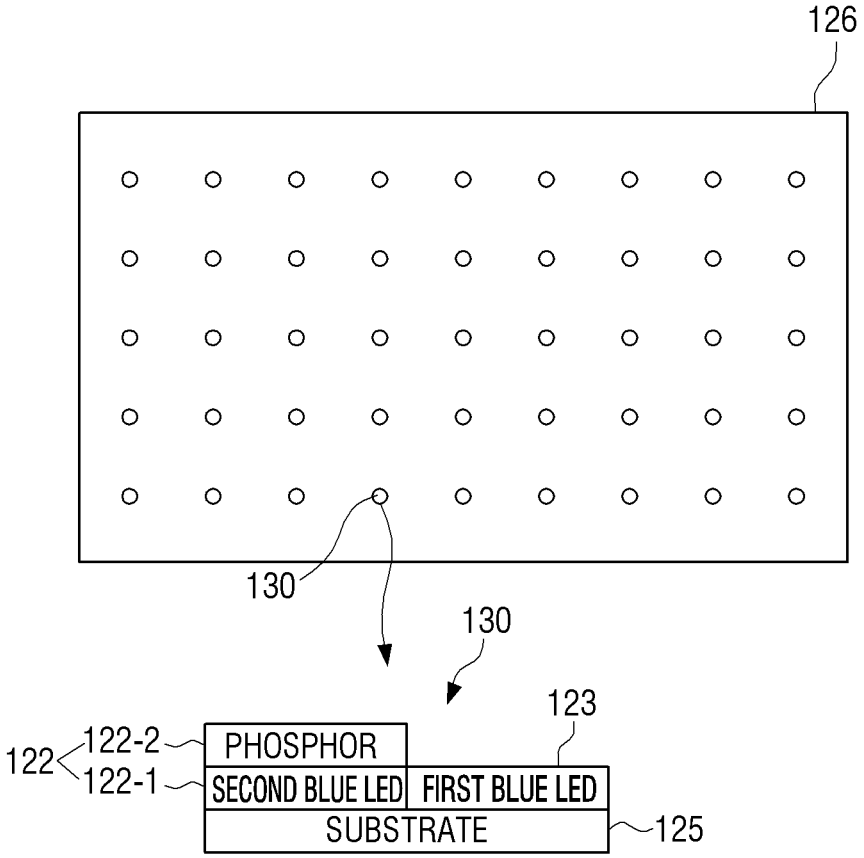
FIGS. 6 and 7 illustrate diverse examples of a configuration of a direct-lit backlight according to exemplary embodiments.
Figure 7:
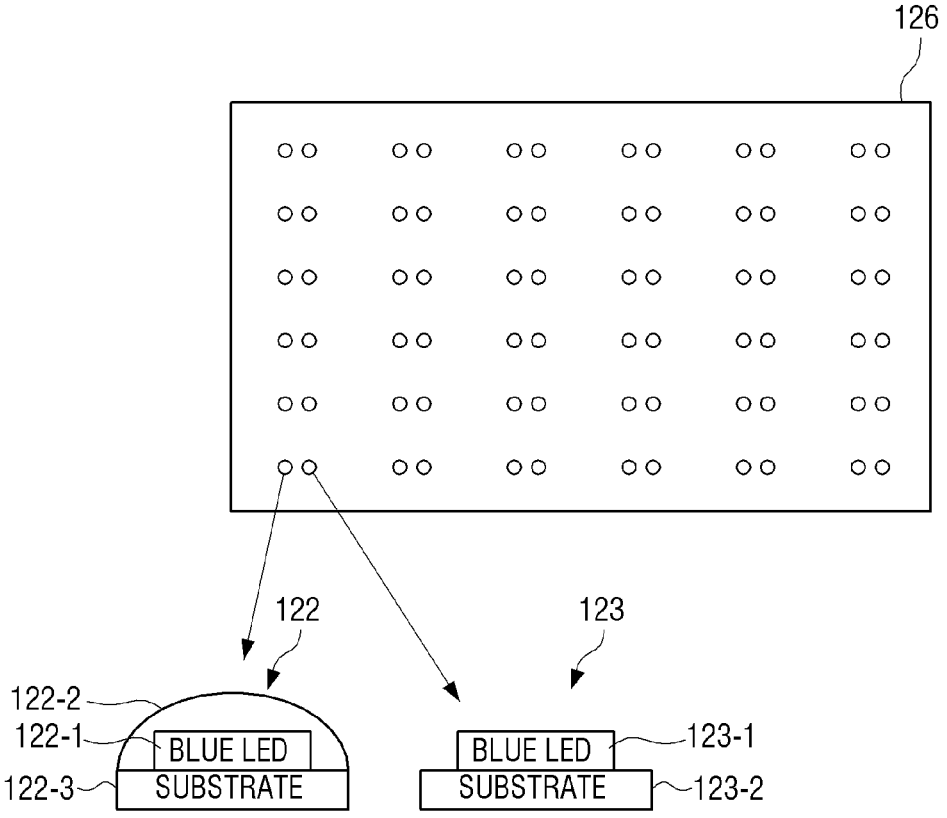

FIGS. 6 and 7 illustrate diverse examples of a configuration of a direct-lit backlight according to exemplary embodiments.

With reference to FIG. 6, the backlight 120 may include a base plate 126 and LED chips 130. The LED chips 130 may be arranged in a predetermined pattern on the base plate 126. In FIG. 6, the LED chips 130 are arranged at regular intervals, but are not limited thereto. The intervals may be designed differently according to whether the intervals are located at a central portion or an edge portion.

On each LED chip 130, a white LED 122 and a blue LED 123 are integrated. The white LED 122 is a blue LED 122-1 coated with phosphor 122-2. In FIG. 6, for convenient description, the blue LED used for the white LED 122 is referred to as a second blue LED 122-1, and a separate blue LED is referred to as a first blue LED 123.

The first and second blue LEDs 123 and 122-1 are manufactured on a substrate 125 all at once, and only the second blue LED 122-1 is coated with the phosphor 122-2 so that one LED chip 130 on which the white light source and the blue light source coexist may be manufactured. On the substrate 125, electrical wirings which are connected to the first and second blue LEDs 123 and 122-1 are provided respectively. Accordingly, the blue light source and the white light source may be individually turned on or off.

FIG. 7 illustrates a configuration of the backlight 120 according to another exemplary embodiment. With reference to FIG. 7, the backlight 120 may include a base plate 126, a plurality of white light sources 122, and a plurality of blue light sources 123.

Each white light source 122 may be implemented with a white LED chip which is transformed from a blue LED 122-1 by being coated with phosphor 122-2 on a substrate 122-3.

In addition, each blue light source 123 may be implemented with a blue LED chip including a blue LED 123-1 on a substrate 123-2.

Accordingly, the white light sources and the blue light sources 122 and 123 may be individually turned on or off by electrical wirings provided on the base plate 126.

In FIGS. 6 and 7, each light source includes the substrate 125, 122-3, or 123-2. However, the base plate 126 may also act as a substrate according to exemplary embodiments.

In addition, the white light source 122 and the blue light source 123 on the edge-lit backlight 120 of FIG. 3 are implemented with separate LEDs as in FIG. 7. However, the white light source 122 and the blue light source 123 on the edge-lit backlight 120 may also be implemented with a single LED chip as in FIG. 6.

The backlight 120 may include the white light source 122 and the blue light source 123 as described above. The backlight driver 220 drives the white light source 122 or the blue light source 123 selectively to express R, G, and B.

FIGS. 8 to 12 illustrate diverse examples of a method for driving the backlight 120 according to exemplary embodiments.

Figure 8:
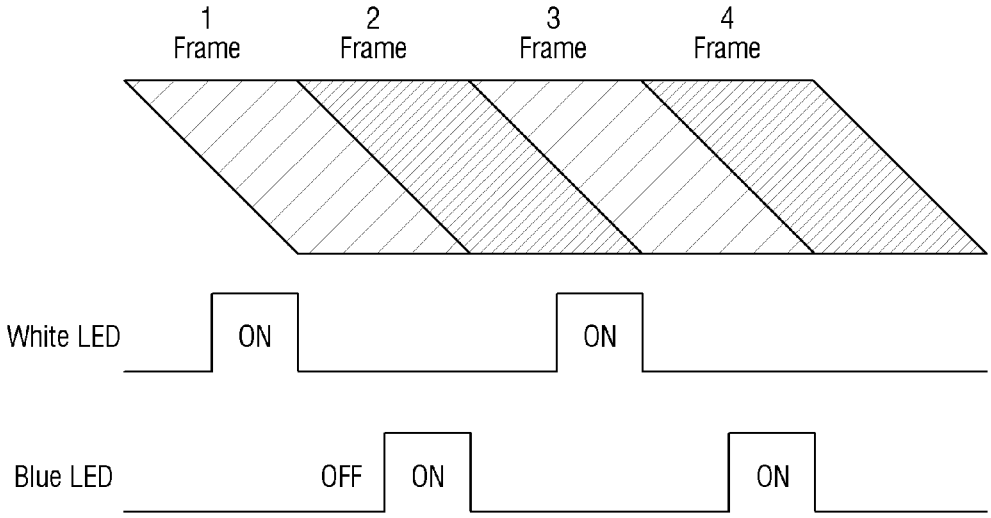
FIGS. 8 to 12 illustrate diverse examples of a method for driving the backlight according to exemplary embodiments.

With reference to FIG. 8, when the panel 110 uses a frame rate of 120 Hz, a first frame in which R and G subframe data are mixed, and a second frame in which B subframe data exist are sequentially displayed at 60 Hz.

Since the first frame includes the mixed R and G subframe data, the panel driver 210 turns on R and G subpixels. The backlight driver 220 turns on the white light source 122 after a predetermined delay time has elapsed since the first frame started to be scanned.

Since the second frame includes the B subframe data, the panel driver 210 turns on a W subpixel. The backlight driver 220 turns on the blue light source 123 after a predetermined delay time has elapsed since the second frame started to be scanned. Accordingly, when the W subpixel is turned on, the blue light source 123 is turned on so that blue color may be expressed using the W subpixel. Using this driving method, video may be smoothly displayed.

Alternatively, a time to turn on the white light source 122 or the blue light source 123 may be determined by a vertical synchronization signal. In a section to output the first frame, the white light source 122 may be turned on in synchronization with a vertical synchronization signal. In addition, in a section to output the second frame, the blue light source 123 may be turned on in synchronization with a vertical synchronization signal.

Also, in sections to output the third and fourth frames, the aforementioned description may be applied in the same manner.

Figure 9:
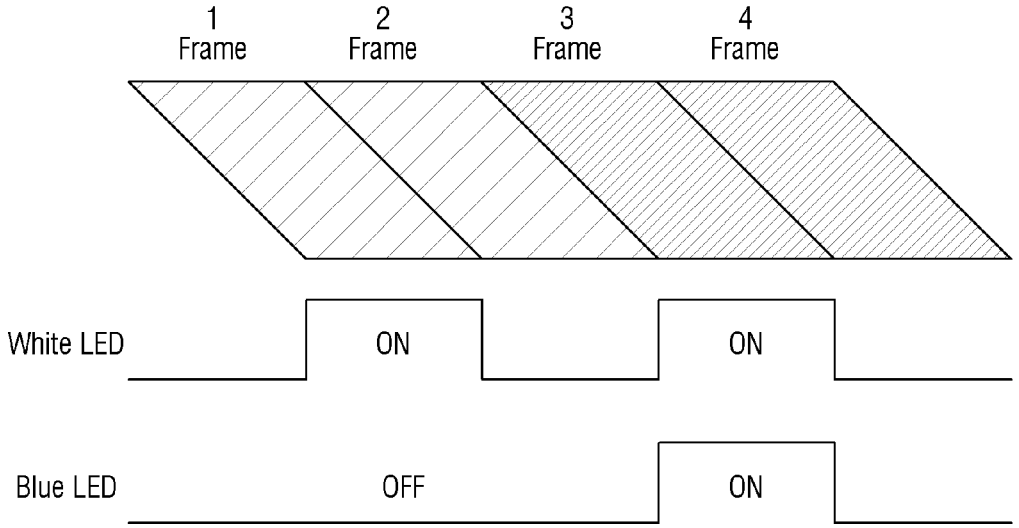

With reference to FIG. 9, when the panel 110 uses a frame rate of 240 Hz, first and second frames in which R and G subframe data are mixed, and third and fourth frames in which B subframe data exist are sequentially displayed at 60 Hz.

Since the first and second frames include the mixed R and G subframe data, the panel driver 210 turns on R and G subpixels. The backlight driver 220 turns on the white light source 122 after a predetermined delay time has elapsed since the first frame started to be scanned, and the backlight driver 220 maintains the turn-on state during a predetermined section in which the first and second frames are displayed.

Since the third and fourth frames include the B subframe data, the panel driver 210 turns on a W subpixel. The backlight driver 220 turns on the white light source 122 and the blue light source 123 together during a predetermined section in which the third and fourth frames are displayed. In the third and fourth frames, the R and G subpixels do not display an image, but only the W subpixel displays an image. Blue and white colors may be expressed using the W subpixel by turning on the white light source 122 and the blue light source 123 at the same time. In this case, the intensity of the white light source 122 may be adjusted using a pulse width modulation (PWM) dimming method.

When the backlight 120 is driven as shown in FIG. 9, white light together with blue light is emitted while the W subpixel is turned on. Accordingly, the brightness may be improved.

Figure 10:
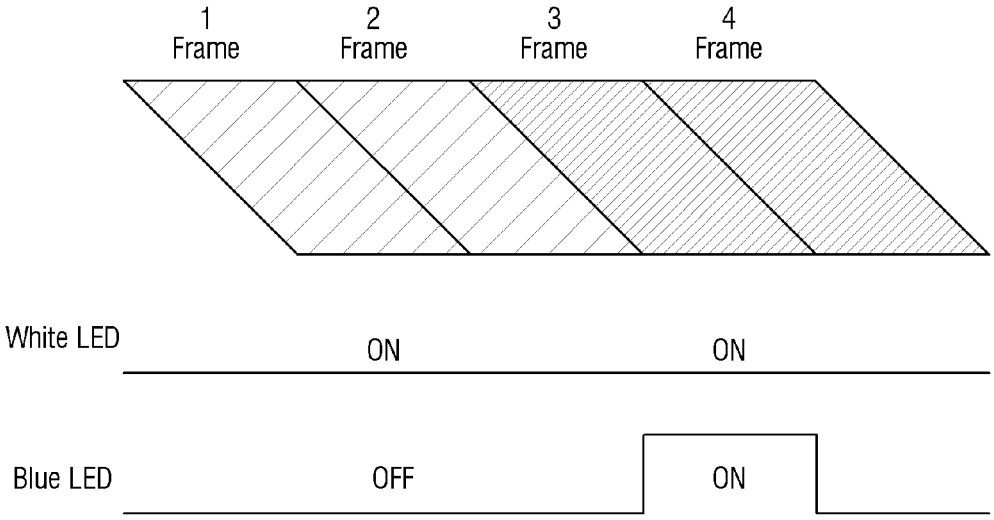

With reference to FIG. 10, when the panel 110 uses a frame rate of 240 Hz, first and second frames in which R and G subframe data are mixed, and third and fourth frames in which B subframe data exist are sequentially displayed at 60 Hz.

While the first and second frames are displayed, the panel driver 210 turns on R and G subpixels and turns off a W subpixel. The backlight driver 220 leaves the white light source 122 on.

While the third and fourth frames are displayed, the panel driver 210 turns off R and G subpixels, and only the W subpixel displays an image. Accordingly, while the third and fourth frames are displayed, both blue light and white light may be expressed using the W subpixel. Consequently, the brightness may be improved.

Figure 11:
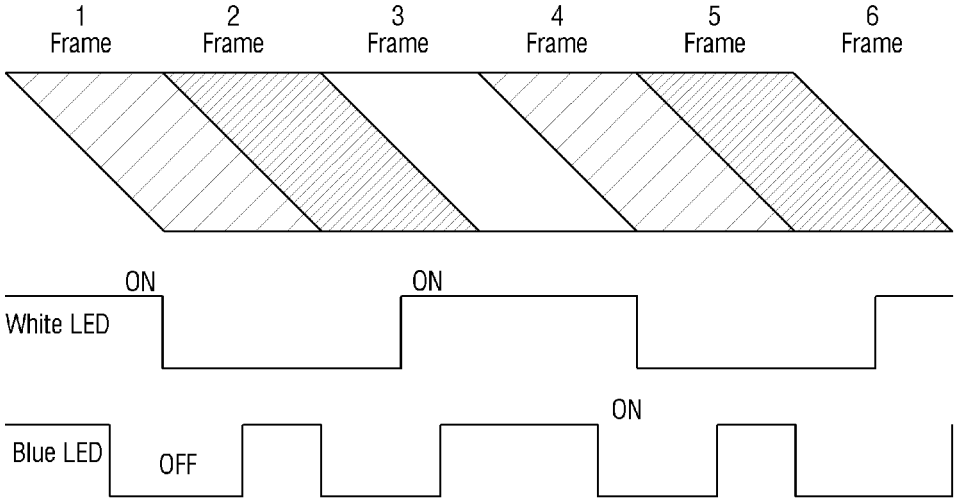
Figure 12:
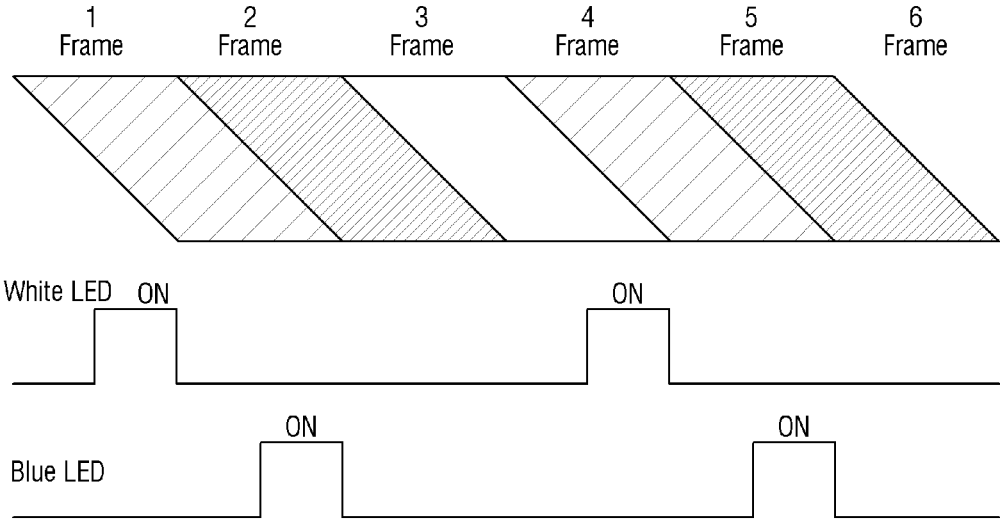

FIGS. 11 and 12 illustrate a method for driving the backlight 120 in the display apparatus 1000 in a transparent mode according to exemplary embodiments.

The panel 110 includes a W subpixel which is a transparent pixel, and thus may be used for a transparent display system.

The transparent display system is a device that has transparency and thus the background behind the device is visible. In the related art, display panels are produced using opaque semiconductor compounds such as Si and GaAs. However, as diverse application fields which are not covered by the existing display panels have developed, an effort to develop new types of electronic elements has been made. One of the products developed as a result of this effort is a transparent display apparatus. The transparent display apparatus includes a transparent oxide semiconductor film and thus has transparency. When the transparent display apparatus is used, the user may view information on a screen of the transparent display apparatus while still being able to see the background behind the transparent display apparatus. Accordingly, spatial and temporal constraints that the related-art display apparatuses have may be solved.

More specifically, the display apparatus 1000 provides a first transparent mode and second transparent mode. In the first transparent mode, the controller 230 turns off all of the R, G, and W subpixels, and provides the panel 110 with light from at least one of the white light source and the blue light source.

When the controller 230 turns off all of the R, G, and W subpixels, and provides the panel 110 with light from the white light source, the light from the white light source passes through the panel 110 and is output. Accordingly, the interior of the display apparatus 1000 is visible to the user.

In addition, when the controller 230 turns off all of the R, G, and W subpixels, and provides the panel 110 with light from the blue light source, the light from the blue light source passes through the panel 110 and is output. Accordingly, the interior of the display apparatus 1000 is visible to the user in blue.

In addition, when the controller 230 turns off all of the R, G, and W subpixels, and provides the panel 110 with light from the white light source and the blue light source alternately, the light from white light source and the blue light source pass through the panel 110 and are output alternately. A neon sign effect may be expressed.

In addition, in the second transparent mode, the controller 230 turns off all of the R, G, and W subpixels, and turns off the white light source and the blue light source.

When the controller 230 turns off all of the R, G, and W subpixels, and turns off the white light source and the blue light source, the background behind the display apparatus 1000 instead of the interior of the display apparatus 1000 is visible to the user.

Figure 13:
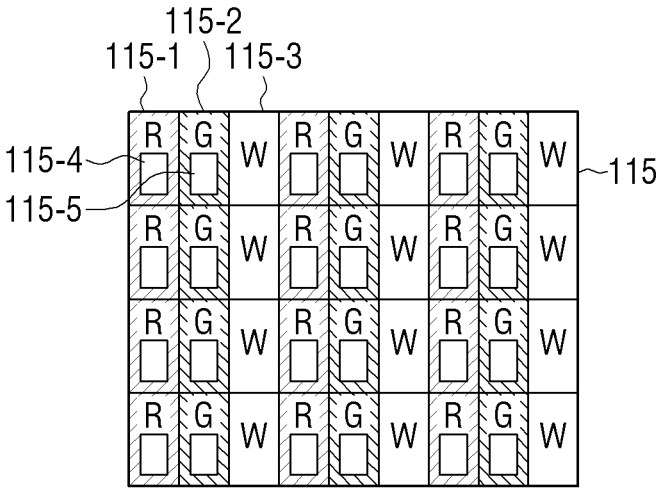
FIG. 13 illustrates an example of a configuration of a color filter used in a transparent display apparatus according to an exemplary embodiment.

FIG. 13 illustrates an example of a configuration of a color filter used in a transparent display apparatus according to an exemplary embodiment.

With reference to FIG. 13, a configuration of the color filter 115 on which R, G, and W subpixels are combined is illustrated.

On the color filter 115, R, G, and W subpixel areas 115-1, 115-2, and 115-3 are sequentially arranged. The R and G subpixel areas 115-1 and 115-2 include locally transparent areas 115-4 and 115-5. Since the W subpixel area 115-3 is also transparent, the size of the transparent areas is larger than that of the case that the color filter 115 includes R, G, and B subpixels. Accordingly, transparency may be enhanced.

Figure 14:
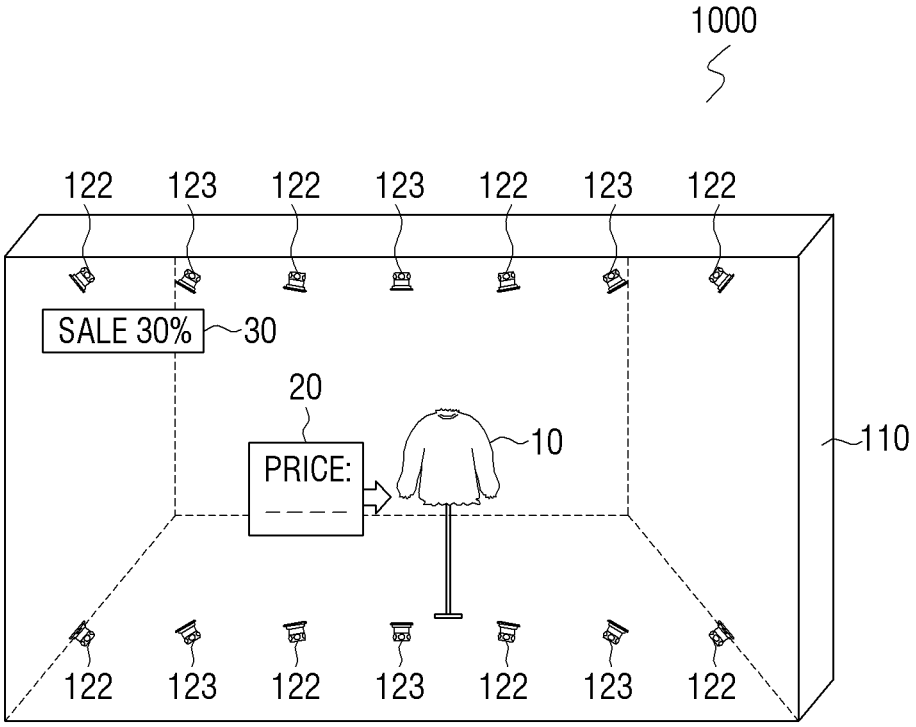
FIG. 14 illustrates a configuration of a transparent display system according to an exemplary embodiment.

FIG. 14 illustrates a configuration of a transparent display system according to an exemplary embodiment.

In the first transparent mode, when the controller 230 turns off all of the R, G, and W subpixels, and provides the panel 110 with light from at least one of the white light source and the blue light source as described above, the interior of the display apparatus is visible to the user. This may be used for an information service such as a kiosk, or an unmanned terminal for unmanned automation.

With reference to FIG. 14, the transparent display apparatus 1000 may include a transparent panel 110, a plurality of white light sources 122, and a plurality of blue light sources 123.

The transparent panel 110 may be implemented with a transparent material such as the color filter 115 as shown in FIG. 13. When the transparent panel 110 has a configuration as shown in FIG. 2, a transparent substrate, a transparent optical film, a color filter, a transparent TFT, a transparent electrode, and the like may be used.

For example, the protective layer 118 as shown in FIG. 2 may be implemented with a transparent substrate. The transparent substrate may be formed of glass or a polymer material such as plastic.

The first and second polarizing layers 111 and 117 may be implemented with transparent plastic optical films. For example, polyvinyl alcohol (PVA) films which absorb a polarizing medium such as iodine or dye may be used.

The transistor layer 113 may be implemented with a transparent transistor layer including transistors in which opaque silicon of an existing TFT is replaced with a transparent substance such as zinc oxide and titanium oxide.

The electrode used in the panel 110 may be implemented with a transparent electrode. The transparent electrode may be a substance such as indium tin oxide (ITO) or grapheme.

The color filter 115 may be formed of a transparent plastic material including a color resist binder to form pixels such as R and G pixels, and a protective film. A Copolymer of acrylic acid and acrylate ester may be used as the binder polymer to form pixels. Acrylic thermosetting plastics, polyimide (PI), or epoxy resin may be used as the protective film.

The color filter 115 includes a color filter layer which is divided into at least one color filter area and a transparent filter area. Each color filter area includes a locally transparent area.

When the transparent display apparatus 1000 employs a transparent panel 110, the background behind the transparent display apparatus 1000 is visible to a user viewing the transparent display apparatus 1000. In FIG. 14, the transparent display apparatus 1000 implements a show window, that is, a kiosk. In this case, a product 10 displayed in the show window is shown, and separate information 20 and 30 may be further displayed on the transparent panel 110.

In FIG. 14, information 20 regarding the product 10 and other information 30 may be displayed in a graphic message form. In addition, a screen to run diverse types of applications, a screen to play back content, a web page, or other graphic objects may also be displayed on the transparent panel 110.

Figure 17:
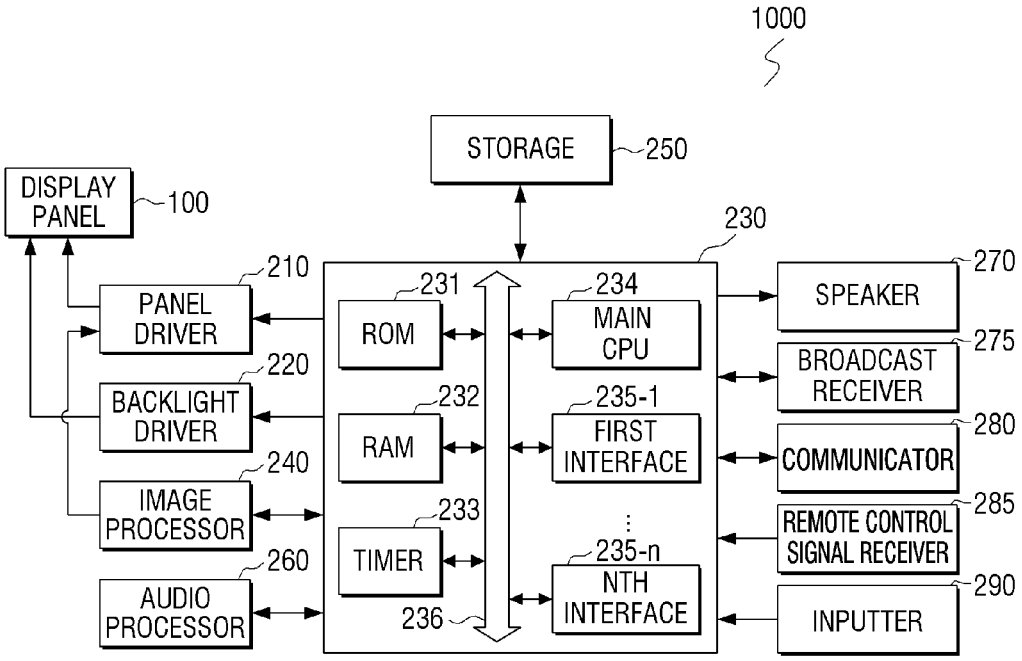
FIG. 17 is a detailed block diagram of a display apparatus which is implemented with a television according to an exemplary embodiment.

When the transparent display apparatus 1000 shown in FIG. 14 has a configuration as shown in FIG. 17, the controller 230 may generate such information by running diverse programs stored in the storage 250, and perform rendering according to generated display properties. Consequently, the diverse information 20 and 30 may be displayed on the transparent panel 110.

In FIG. 14, a backlight is not used, but at least one white light source 122 and at least one blue light source 123 are provided behind the transparent panel 110, so that backlight may be provided to the transparent panel 110. In FIG. 14, the white light source 122 and the blue light sources 123 are provided at an upper surface and a lower surface of a space behind the transparent panel 110. However, the white light source 122 and the blue light source 123 may also be provided at a left surface and a right surface.

In the transparent display apparatus 1000 as shown in FIG. 14, the white light source 122 and the blue light source 123 may be implemented with a single LED chip as shown in FIG. 6, or may be implemented with a white lamp and a blue lamp.

In the transparent display apparatus 1000 as shown in FIG. 14, the controller 230, which is connected to the transparent panel 110 controls the transparent panel 110 and the light sources 122 and 123, expresses R, G, and B sequentially, and displays a color image accordingly.

Figure 15:
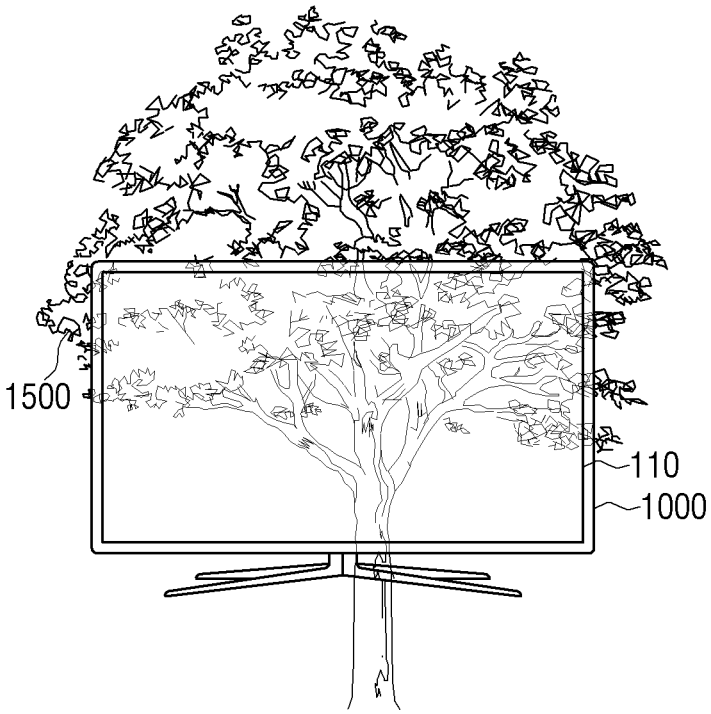
FIG. 15 illustrates a transparent display apparatus according to another exemplary embodiment.

FIG. 15 illustrates a transparent display apparatus 1000 according to another exemplary embodiment.

With reference to FIG. 15, the transparent display apparatus 1000 includes a transparent panel 110 as in FIG. 14, and unlike FIG. 14, a white light source and a blue light source are turned off so that backlight is not provided.

Accordingly, an object behind the transparent display apparatus 1000 is visible to the user. In FIG. 15, a tree 1500 is behind the transparent display apparatus 1000. When the white light source and the blue light source are not turned on, the tree 1500 is visible to the user through the transparent panel 110.

This transparent display apparatus 1000 may be applied to mobile terminals, projectors, and video walls as well as TVs, but is not limited thereto.

A method for driving the backlight 120 of the transparent display apparatus 1000 is described in detail with reference to FIGS. 11 and 12.

FIG. 11 illustrates a method for driving the backlight 120 of the display apparatus 1000 shown in FIG. 14 in the first transparent mode.

With reference to FIG. 11, when the panel 110 uses a frame rate of 180 Hz, a first frame in which R and G subframe data are mixed, a second frame in which B subframe data exist, and a third frame which operates in the transparent mode are sequentially displayed at 60 Hz.

Since the first frame includes the mixed R and G subframe data, the panel driver 210 turns on R and G subpixels. The backlight driver 220 turns on the white light source 122 when the first frame is started to be scanned, and the backlight driver 220 maintains the turn-on state during a predetermined section in which the first frame is displayed.

Since the second frame includes the B subframe data, the panel driver 210 turns on a W subpixel. The backlight driver 220 turns on the white light source 122 and the blue light source 123 during a predetermined section in which the second frame is displayed. In the second frame, the R and G subpixels do not display an image, but only the W subpixel displays an image. Blue and white colors may be expressed using the W subpixel by turning on the white light source 122 and the blue light source 123 at the same time. In this case, the intensity of the white light source 122 may be adjusted using a pulse width modulation (PWM) dimming method. When the backlight 120 is driven in this manner, white light together with blue light is emitted while the W subpixel is turned on. Accordingly, the brightness may be improved.

In the third frame in which there is no R, G, and B subframe data and the display apparatus 1000 operates in the transparent mode, the panel driver 210 turns off all the R, G, and W subpixels, and the backlight driver 220 turns on at least one of the white light source 122 and the blue light source 123, and maintains the turn-on state during a section in which the third frame is displayed. In this case, white light or blue light emitted from the white light source 122 or the blue light source 123 illuminates the interior of the transparent display apparatus 1000 and is reflected so that the interior of the transparent display apparatus 1000 may be visible to the user.

In FIG. 11, in the third frame operating in the transparent mode, the panel driver 210 turns off all the R, G, and W subpixels. However, even when the R and G subpixels are turned off and the W subpixel is turn on, the general inventive concept may be applied. The W subpixel is a transparent pixel, so although the W subpixel is turned on, the third frame may operate in the transparent mode.

FIG. 12 illustrates a method for driving the backlight 120 of the display apparatus 1000 shown in FIG. 15 in the second transparent mode.

With reference to FIG. 12, when the panel 110 uses a frame rate of 180 Hz, a first frame in which R and G subframe data are mixed, a second frame in which B subframe data exist, and a third frame which operates in the transparent mode are sequentially displayed at 60 Hz.

Since the first frame includes the mixed R and G subframe data, the panel driver 210 turns on R and G subpixels. The backlight driver 220 turns on the white light source 122 when the first frame is started to be scanned, and the backlight driver 220 maintains the turn-on state during a predetermined section in which the first frame is displayed.

Since the second frame includes the B subframe data, the panel driver 210 turns on a W subpixel. The backlight driver 220 turns on the white light source 122 and the blue light source 123 during a predetermined section in which the second frame is displayed. In the second frame, the R and G subpixels do not display an image, but only the W subpixel displays an image. Blue and white colors may be expressed using the W subpixel by turning on the white light source 122 and the blue light source 123 at the same time. In this case, the intensity of the white light source 122 may be adjusted using a pulse width modulation (PWM) dimming method. When the backlight 120 is driven in this manner, white light together with blue light is emitted while the W subpixel is turned on. Accordingly, the brightness may be improved. However, the backlight driver 220 may turn on only the blue light source 123 during a predetermined section in which the second frame is displayed.

In the third frame in which there is no R, G, and B subframe data and the display apparatus 1000 operates in the transparent mode, the panel driver 210 turns off all the R, G, and W subpixels, and the backlight driver 220 turns off all the white light source 122 and the blue light source 123 during a section in which the third frame is displayed. Since the white light source 122 and the blue light source 123 are turned off, an object behind the transparent display apparatus 1000 is visible to the user by natural light.

In FIG. 12, in the third frame operating in the transparent mode, the panel driver 210 turns off all the R, G, and W subpixels. However, even when the R and G subpixels are turned off and the W subpixel is turn on, the general inventive concept may be applied. The W subpixel is a transparent pixel, so although the W subpixel is turned on, the third frame may operate in the transparent mode.

Figure 16:
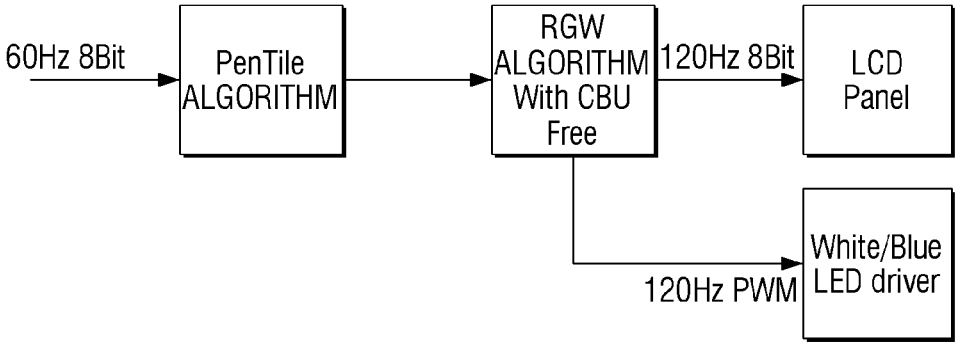
FIG. 16 illustrates a PenTile™ conversion algorithm to apply to a PenTile™ structure according to an exemplary embodiment.

FIG. 16 illustrates a PenTile™ conversion algorithm to apply to a PenTile™ structure according to an exemplary embodiment.

The image processor 240 may convert image data into a form corresponding to a PenTile™ structure, and convert the converted image data into R, G, and B subframe data.

Figure 19:
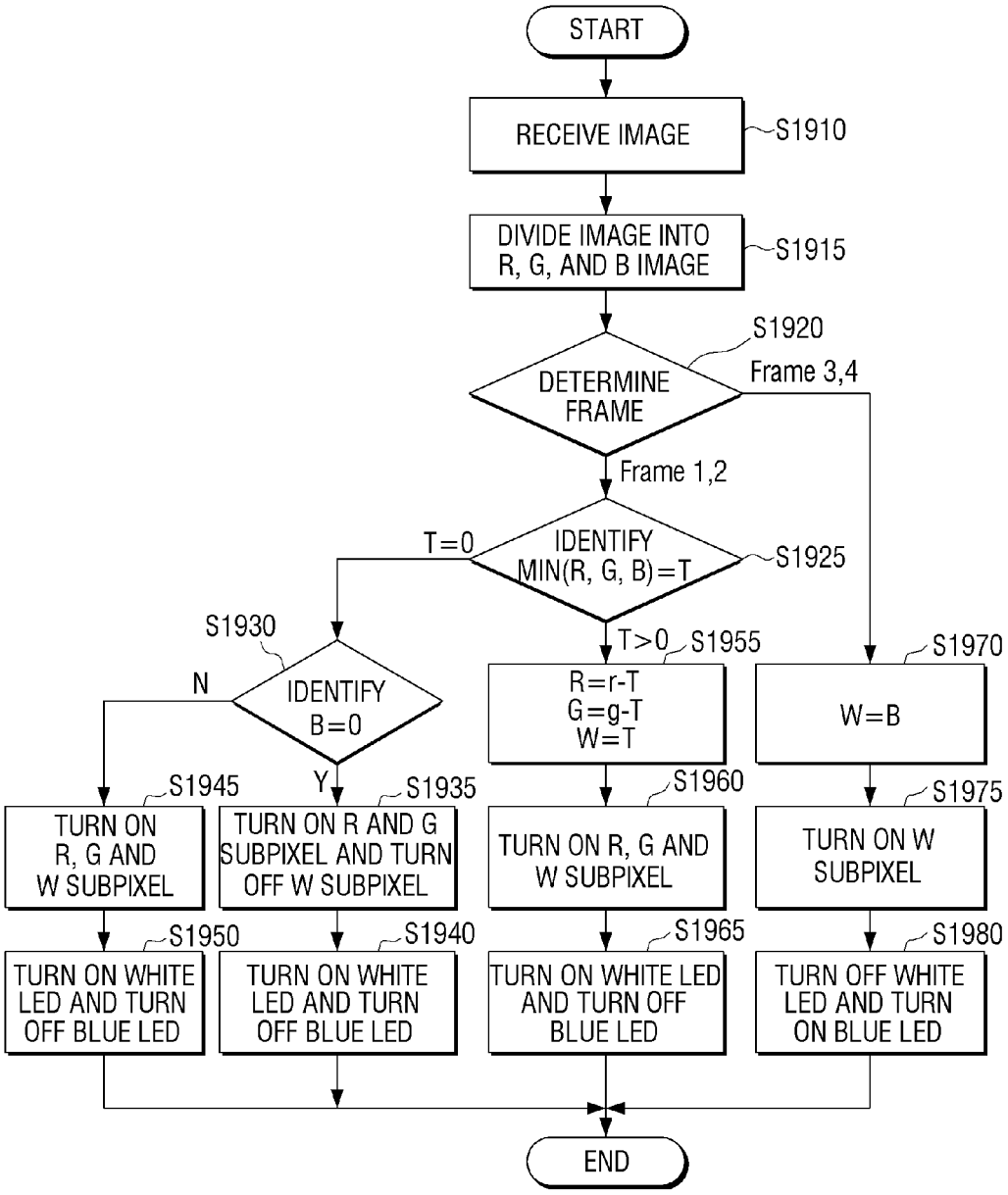
FIG. 19 illustrates in detail an example of a panel driving method and a backlight driving method based on an R, G, and W image generation algorithm according to an exemplary embodiment.

With reference to FIG. 16, when an image signal having a frame rate of 60 Hz is received, R, G, and W images are generated using an RGW algorithm in order to apply to the PenTile™ structure, that is, the image signal is converted to be suitable for R, G, and W subpixels, is converted into 120 Hz, and is transmitted to an LCD panel, and white LED and blue LED drivers, respectively. With reference to FIG. 19, the R, G, and W image generation algorithm is described in greater detail.

FIG. 19 illustrates in detail an example of a panel driving method and a backlight driving method based on the R, G, and W image generation algorithm according to an exemplary embodiment.

With reference to FIG. 19, when an image is input (S1910), the image is divided into R, G, and B images (S1915). The display apparatus 1000 generates a plurality of frames by combining the divided images appropriately. For example, as described with reference to FIGS. 8 to 12, a first frame is generated by mixing the R and G images, a second frame is generated using the B image, and subsequently the first frame and the second frame are displayed sequentially. In addition, a third frame which does not output an image may be additionally generated and be displayed.

When it is determined that a currently displayed frame is the first or second frame (S1920), the display apparatus 1000 identifies a minimum value T of the R, G, and B images (S1925). When T is 0, the display apparatus 1000 identifies whether B is 0 (S1930). When B is not 0, the R image or the G image is 0. Accordingly, the display apparatus 1000 turns on the R, G, and W subpixels (S1945), turns on the white LED, that is, the white light source, and turns off the blue LED, that is, the blue light source (S1950).

When B is 0, the display apparatus 1000 turns on the R and G subpixels and turns off the W subpixel (S1935), and turns on the white LED and turns off the blue LED (S1940).

When T is greater than 0, the R subpixel is set to T subtracted from r value, where the r value corresponds to the original R image value (i.e., R subframe data), the G subpixel is set to T subtracted from g value, where the g value corresponds to the original G image value (i.e., G subframe data), the W subpixel is set to T (S1955), and the display apparatus 1000 drives each pixel to the set value (S1960).

In this state, the display apparatus 1000 turns on the white LED and turns off the blue LED (S1965).

When it is determined that a currently displayed frame is the third or fourth frame (S1920), the W subpixel is driven to a brightness value corresponding to the B image (S1970 and S1975). In this state, the display apparatus 1000 turns off the white LED and turns on the blue LED (S1980).

In another exemplary embodiment, with reference to the third and fourth frames, the white LED may be turned on together with the blue LED, or may be turned on continuously, so that the brightness may be prevented from being reduced.

According to the diverse exemplary embodiments, the problem of low brightness in R, G, and B subpixel structures may be solved by adding the W subpixel and using the blue LED.

FIG. 17 is a detailed block diagram of the display apparatus 1000 which is implemented with a television according to an exemplary embodiment.

With reference to FIG. 17, the display apparatus 1000 may include a display panel 100, a panel driver 210, a backlight driver 220, a controller 230, an image processor 240, a storage 250, an audio processor 260, a speaker 270, a broadcast receiver 275, a communicator 280, a remote control signal receiver 285, and an inputter 290.

Since the operation of the display panel 100, the panel driver 210, the backlight driver 220, the controller 230, and the image processor 240 has been described above in detail, description thereof is not repeated here.

The storage 250 may store an operating system (OS) to drive the display apparatus 1000, software and firmware to perform diverse functions, applications, contents, setting information which is input or set by the user while running an application, and unique information to indicate the features of the display apparatus 1000.

The controller 230 may control overall operation of the display apparatus 1000 using diverse programs stored in the storage 250.

The controller 230 may include a read-only memory (ROM) 231, a random-access memory (RAM) 232, a timer 233, a main central processing unit (CPU) 234, diverse types of interfaces 235-1 to 235-N, and a bus 236.

The ROM 231, the RAM 232, the timer 233, the main CPU 234, and the diverse types of interfaces 235-1 to 235-N may be connected to one another via the bus 236 to transmit or receive diverse data or signals.

The first to $N^{th}$ interfaces 235-1 to 235-N are connected to other components as well as the components illustrated in FIG. 17 so that the main CPU 234 may access other components. For example, when a device such as a universal serial bus (USB) memory is connected, the main CPU 234 may access the USB memory through a USB interface.

When the display apparatus 1000 is connected to an external power supply, the main CPU 234 operates in a standby state. In the standby state, when a turn-on command is received through diverse receiving means such as the remote control signal receiver 285 or the inputter 290, the main CPU 234 accesses the storage 250 and boots up the system using an operating system (OS) stored in the storage 250. Subsequently, the main CPU 234 sets up diverse functions of the display apparatus 1000 according to user setting information pre-stored in the storage 250.

More specifically, the ROM 231 stores a set of commands to boot up the system. When a turn-on command is input and the power is supplied, the main CPU 234 copies an operating system (OS) stored in the storage 250 to the RAM 232 according to the commands stored in the ROM 231 and executes the OS so that the system can boot up. When the boot-up is complete, the main CPU 234 copies diverse application programs stored in the storage 250 to the RAM 232, and runs the copied application programs so that diverse operations can be performed.

The timer 233 counts the time according to control of the main CPU 234. In the aforementioned exemplary embodiment, the white light source 122 or the blue light source 123 is turned on after a predetermined delay time has elapsed since panel scanning. In this case, the main CPU 234 controls the timer 233 to count the time elapsed after panel scanning starts, and the main CPU 234 controls the backlight driver 220 to provide white light or blue light according to the counting results.

The remote control signal receiver 285 receives a remote control signal transmitted from a remote control. The remote control signal receiver 285 may include a light receiver to receive an infrared (IR) signal, or may receive a remote control signal in communication with the remote control according to wireless communication protocols such as Bluetooth and wireless fidelity (Wi-Fi).

The inputter 290 may be implemented with diverse buttons provided on a main body of the display apparatus 1000. The user may input diverse user commands such as a turn-on or turn-off command, a channel change command, a volume control command, and a menu identification command through the inputter 290.

The broadcast receiver 275 tunes in to a broadcast channel, and receives and processes a broadcast signal. The broadcast receiver 275 may include a tuner, a demodulator, an equalizer, and a demultiplexer. The broadcast receiver 275 tunes in to a broadcast channel according to control of the controller 230, receives a broadcast signal that the user wants, demodulates and equalizes the broadcast signal, and demultiplexes the broadcast signal into video data, audio data, and additional data.

The demultiplexed video data is transmitted to the image processor 240. The image processor 240 performs diverse image processing of the video data, such as noise filtering, frame rate conversion, resolution conversion, and the like, and thus generates a frame to output on the screen. In this process, the image processor 240 may generate color frame data by separating each color data such as R, G, and B included in the video data.

The demultiplexed audio data is transmitted to the audio processor 260. The audio processor 260 performs diverse processing of the audio data, such as decoding, amplification, noise filtering, and the like.

A graphic processor (not shown) may be further included. The graphic processor composes diverse on-screen display (OSD) messages or a graphic screen according to control of the main CPU 234. When a broadcast signal includes additional data such as subtitle data, the main CPU 234 controls the graphic processor to generate a subtitle image, map the generated subtitle image to each frame generated by the image processor 240, and thus compose a frame.

The speaker 270 outputs audio data processed by the audio processor 260. The controller 230 controls the speaker 270 in line with the display panel 100 so that video and audio data may be synchronized.

The communicator 280 communicates with diverse external sources according to diverse communication protocols. More specifically, diverse communication protocols such as IEEE, Wi-Fi, Bluetooth, $3^{rd}$ generation (3G), $4^{th}$ generation (4G), and near field communication (NFC) may be used.

The controller 230 may reproduce multimedia data received from an external source through the communicator 280 as well as a broadcast signal received through the broadcast receiver 275.

In addition, when a command to reproduce multimedia data stored in the storage 250 is input through the remote control signal receiver 285 or the inputter 290, the controller 230 controls the image processor 240 and the audio processor 260 to process the multimedia data.

When the display apparatus 1000 reproduces multimedia data as well as a broadcast signal, the display apparatus 1000 operates the panel 110 and the backlight 120 as described above so that an image having appropriate brightness and color may be displayed.

When the display apparatus 1000 is a multifunctional terminal device such as a mobile phone or a tablet computer, diverse components such as a camera, a touch sensor, a geomagnetic sensor, a gyro sensor, an acceleration sensor, and a global positioning system (GPS) chip may be further included.

Figure 18:
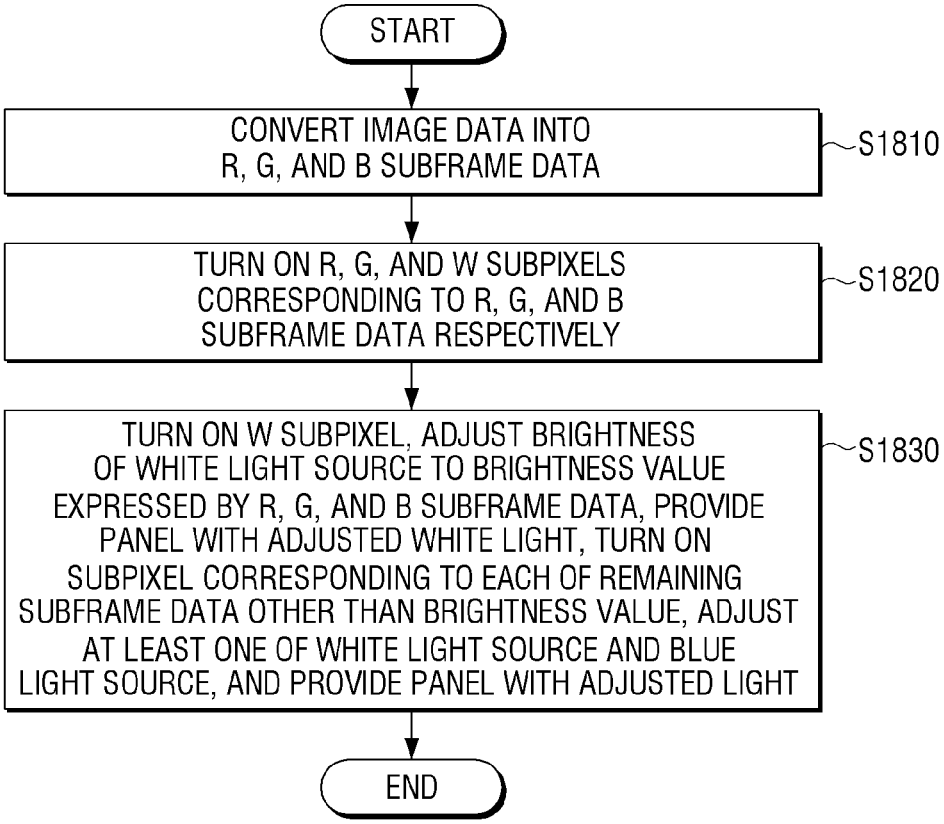
FIG. 18 is a flowchart of a control method of a display apparatus according to an exemplary embodiment.

FIG. 18 is a flowchart of a control method of the display apparatus 1000 according to an exemplary embodiment.

With reference to FIG. 18, a control method of a display apparatus including a panel to include red (R), green (G), and white (W) subpixels, and a backlight to provide the panel with backlight using at least one of a white light source and a blue light source includes converting image data into red (R), green (G), and blue (B) subframe data (S1810).

The control method includes turning on the R, G, and W subpixels corresponding to the R, G, and B subframe data respectively (S1820).

The control method includes turning on the W subpixel, adjusting the brightness of the white light source to a brightness value expressed by the R, G, and B subframe data, providing the panel with the adjusted white light, turning on subpixel respectively corresponding to remaining subframe data other than the brightness value, adjusting the brightness of at least one of the white light source and the blue light source, and providing the panel with the adjusted light (S1830).

In the operation of S1830, at least one of the R and G subpixels are turned on for remaining data other than data corresponding to the brightness value from among at least one of the R and G subframe data, and the brightness of the white light source is adjusted to correspond to the remaining data, the W subpixel is turned on for remaining data other than data corresponding to the brightness value from among the B subframe data, and the brightness of the blue light source is adjusted to correspond to the remaining data.

In addition, in the operation of S1830, the W subpixel is turned on to correspond to a minimum value among the R, G, and B subframe data, and the panel is provided with the white light source so that the brightness value expressed by the R, G, and B subframe data is expressed.

The W subpixel is a transparent pixel. Accordingly, the display apparatus provides first transparent mode and second transparent mode. In the first transparent mode, turning off all the R, G, and W subpixels, and turning on at least one of the white light source and the blue light source may be further included. In the second transparent mode, turning off all the R, G, and W subpixels, and turning off the white light source and the blue light source may be further included.

The blue light source may include a plurality of blue light emitting diodes (LEDs), and the white light source may include a plurality of white LEDs in which blue LEDs are coated with phosphor. Each blue LED and each white LED may be integrated on a single LED chip.

In addition, the blue light source may include a plurality of blue LED chips, and the white light source may include a plurality of white LED chips in which blue LEDs are coated with phosphor. Each blue LED chip and each white LED chip may be arranged side by side.

In the operation of S1830, the brightness of at least one of the white light source and the blue light source may be adjusted in a pulse width modulation (PWM) dimming method.

In the operation of S1810, the image data may be converted into a form corresponding to a PenTile™ structure and then be converted into the R, G, and B subframe data.

A program to sequentially perform the control method according to the exemplary embodiments may be stored in a non-transitory computer readable medium and be provided.

For example, a program to perform the operations of converting image data into red (R), green (G), and blue (B) subframe data, turning on the R, G, and W subpixels corresponding to the R, G, and B subframe data respectively, and turning on the W subpixel, adjusting the brightness of the white light source to a brightness value expressed by the R, G, and B subframe data, providing the panel with the adjusted white light, turning on subpixel corresponding to remaining subframe data respectively other than the brightness value, adjusting the brightness of at least one of the white light source and the blue light source, and providing the panel with the adjusted light may be stored in a non-transitory computer readable medium, and be provided.

In addition, for example, a program to perform the operations of, in the first transparent mode, turning off all the R, G, and W subpixels, and turning on at least one of the white light source and the blue light source may be further included, and in the second transparent mode, turning off all the R, G, and W subpixels, and turning off the white light source and the blue light source may be stored in a non-transitory computer readable medium, and be provided.

The non-transitory computer readable medium is a medium which stores data semi-permanently and is readable by devices. More specifically, the aforementioned applications or programs may be stored in the non-transitory computer readable media such as compact disks (CDs), digital video disks (DVDs), hard disks, Blu-ray disks, universal serial buses (USBs), memory cards, and read-only memory (ROM).

The display apparatus 1000 may further include at least one of a processor, such as a CPU and a microprocessor, a hardware module, or a circuit to perform the aforementioned operations. The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the inventive concept, as defined by the appended claims, and many alternatives, modifications, and variations will be apparent to those skilled in the art.

What is claimed is:

1. A display apparatus comprising:

a panel including red (R), green (G), and white (W) subpixels;

a backlight configured to provide the panel with backlight using at least one of a white light source and a blue light source;

an image processor configured to convert image data into red (R), green (G), and blue (B) subframe data;

a panel driver configured to turn on the R, G, and W subpixels according to the R, G, and B subframe data, respectively;

a backlight driver configured to drive the backlight; and a controller configured to control the panel driver to turn on the W subpixel, set brightness of the white light source based on a brightness value corresponding to a minimum value among the R, G, and B subframe data, control the backlight driver to drive the white source to provide the panel with white light at the set brightness, control the panel driver to turn on subpixels respectively corresponding to remaining subframe data other than the R, G, and B subframe data corresponding to the brightness value, set at least one of the brightness of the white light source and brightness of the blue light source, and control the backlight driver to drive at least one of the white light source and the blue light source to provide light at the set brightnesses.

2. The display apparatus as claimed in claim 1, wherein the controller is further configured to control the panel driver to turn on at least one of the R and G subpixels respectively corresponding to at least one of remaining R and G subframe data among the remaining subframe data, and set the brightness of the white light source to correspond to at least one of the remaining R and G subframe data, and the controller is further configured to control the panel driver to turn on the W subpixel corresponding to remaining B subframe data among the remaining subframe data, and set the brightness of the blue light source to correspond to the remaining B subframe data.

3. The display apparatus as claimed in claim 2, wherein the brightness value corresponds to a smallest value among the R, G, and B subframe data.

4. The display apparatus as claimed in claim 1, wherein the W subpixel is transparent.

5. The display apparatus as claimed in claim 4, wherein the display apparatus is configured to provide a first transparent mode and a second transparent mode, and in the first transparent mode, the controller is further configured to control the panel driver to turn off all the R, G, and W subpixels, and control the backlight driver to drive at least one of the white light source and the blue light source to provide the panel with light, and in the second transparent mode, the controller is further configured to control the panel driver turn off all the R, G, and W subpixels, and control the backlight driver to turn off the white light source and the blue light source.

6. The display apparatus as claimed in claim 1, wherein the blue light source comprises a plurality of blue light emitting diodes (LEDs), and the white light source comprises a plurality of white LEDs in which blue LEDs are coated with phosphor, and each blue LED and each white LED are integrated on a single LED chip.

7. The display apparatus as claimed in claim 1, wherein the blue light source comprises a plurality of blue LED chips, and the white light source comprises a plurality of white LED chips in which blue LEDs are coated with phosphor, and each blue LED chip and each white LED chip are arranged side by side.

8. The display apparatus as claimed in claim 1, wherein the controller is further configured to control the backlight driver to drive at least one of the white light source and the blue light source using a pulse width modulation (PWM) dimming method to provide light at the set the brightness.

9. The display apparatus as claimed in claim 1, wherein the image processor is further configured convert the image data into a form corresponding to a PenTile™ structure, and convert the converted image data into the R, G, and B subframe data.

10. A control method of a display apparatus comprising a panel configured to include red (R), green (G), and white (W) subpixels, and a backlight configured to provide the panel with backlight using at least one of a white light source and a blue light source, the method comprising:

converting image data into red (R), green (G), and blue (B) subframe data;

turning on the R, G, and W subpixels according to the R, G, and B subframe data, respectively;

turning on the W subpixel;

setting brightness of the white light source according to a brightness value corresponding to a minimum value among the R, G, and B subframe data;

providing the panel with white light at the set brightness;

turning on subpixels respectively corresponding to remaining subframe data other than the R, G, and B subframe data corresponding to the brightness value; and setting at least one of the brightness of the white light source and a brightness of the blue light source, and providing the panel with light at the set brightnesses.

11. The method as claimed in claim 10, wherein the providing the panel with the light at the set brightnesses comprises:

turning on at least one of the R and G subpixels respectively corresponding to at least one of remaining R and G subframe data among the remaining subframe data;

setting a brightness of the white light source to correspond to at least the remaining R and G subframe data;

turning on the W subpixel corresponding to remaining B subframe data among the remaining subframe data; and setting the brightness of the blue light source to correspond to the remaining B subframe data.

12. The method as claimed in claim 11, wherein the brightness value corresponds to a smallest value among the R, G, and B subframe data.

13. The method as claimed in claim 10, wherein the W subpixel is transparent.

14. The method as claimed in claim 13, wherein the display apparatus provides a first transparent mode and a second transparent mode, the method further comprising:

in the first transparent mode, turning off all the R, G, and W subpixels, and turning on at least one of the white light source and the blue light source, and in the second transparent mode, turning off all the R, G, and W subpixels, and turning off the white light source and the blue light source.

15. The method as claimed in claim 10, wherein the blue light source comprises a plurality of blue light emitting diodes (LEDs), and the white light source comprises a plurality of white LEDs in which blue LEDs are coated with phosphor, and each blue LED and each white LED are integrated on a single LED chip.

16. The method as claimed in claim 10, wherein the blue light source comprises a plurality of blue LED chips, and the white light source comprises a plurality of white LED chips in which blue LEDs are coated with phosphor, and each blue LED chip and each white LED chip are arranged side by side.

17. The method as claimed in claim 10, wherein in the providing the panel with the adjusted light, the brightness of at least one of the white light source and the blue light source is adjusted using a pulse width modulation (PWM) dimming method.

18. The method as claimed in claim 10, wherein in the converting the image data into the R, G, and B subframe data, the image data is converted into a form corresponding to a PenTile™ structure and then is converted into the R, G, and B subframe data.

19. A display apparatus comprising:

a panel comprising a red (R), a green (G), and a white (W) subpixel;

a backlight comprising a white light source and a blue light source and configured to provide light to the panel; and a controller configured to turn on the W subpixel, drive the white light source based on a minimum value among R, G, and B subframe data, determine remaining R, G, and B subframe data by subtracting the smallest value from each of the R, G, and B subframe data, turn on subpixels among the R, G, and W subpixels according the remaining R, G, and B subframe data respectively, and drive at least one of the white light source and the blue light source based on the remaining R, G, and B subframe data.

20. The display apparatus of claim 19, wherein the controller is further configured drive the display apparatus in one of a first transparent mode and a second transparent mode, wherein the controller is further configured to, in the first transparent mode, turn off all of the R, G, and W subpixels, and drive at least one of the white light source and the blue light source, and wherein the controller is further configured to, in the second transparent mode, turn off all of the R, G, and W subpixels, and turn off the white light source and the blue light source.

* * * * *